US005338648A

United States Patent [19]

Kojima et al.

[11] Patent Number: 5,338,648

[45] Date of Patent: Aug. 16, 1994

[54] PROCESS OF PROCESSING SILVER HALIDE PHOTOGRAPHIC MATERIAL AND PHOTOGRAPHIC PROCESSING COMPOSITION HAVING A FIXING ABILITY

[75] Inventors: Tetsuro Kojima; Nobuo Watanabe, both of Kanagawa, Japan

[73] Assignee: Fuji Photo Film Co., Ltd., Kanagawa, Japan

[21] Appl. No.: 127,091

[22] Filed: Sep. 27, 1993

Related U.S. Application Data

[63] Continuation of Ser. No. 836,958, Feb. 19, 1992, abandoned.

[30] Foreign Application Priority Data

Feb. 19, 1991 [JP] Japan ..... 3-45459

[51] Int. Cl.[5] ..... G03C 7/42

[52] U.S. Cl. ..... 430/393; 430/455; 430/460

[58] Field of Search ..... 430/393, 455, 460

[56] References Cited

U.S. PATENT DOCUMENTS

| | | | |
|---|---|---|---|
| 4,707,434 | 11/1987 | Koboshi et al. | 430/460 |
| 4,748,105 | 5/1988 | Kadota et al. | 430/393 |
| 4,908,300 | 3/1990 | Koboshi et al. | 430/460 |
| 4,983,503 | 1/1991 | Ishikawa et al. | 430/393 |

*Primary Examiner*—Hoa Van Le

*Attorney, Agent, or Firm*—Sughrue, Mion, Zinn, Macpeak & Seas

[57] ABSTRACT

A process and composition for processing a silver halide photographic material. The photographic material mat be a black and white photographic material or a color photographic material. The photographic material is processed in a photographic processing bath containing at least one compound represented by the following formula (I) and substantially not containing a thiosulfate ion:

(I)

wherein Q represents an atomic group necessary for forming a 5- or 6-membered heterocyclic ring, which heterocyclic ring may be condensed with a carbon aromatic ring or a hetero-aromatic ring; R represents an alkyl group, an alkenyl group, an aralkyl group, an aryl group or a heterocyclic group, each group represented by R being substituted by at least one substituent selected from the group consisting of a carboxyl group or salt thereof a sulfonic acid group or salt thereof a phosphonic acid group or salt thereof, an amino group and an ammonium group, or R represents a single bond; n represents an integer or from 1 to 3; and M represents a cation group.

7 Claims, No Drawings

PROCESS OF PROCESSING SILVER HALIDE PHOTOGRAPHIC MATERIAL AND PHOTOGRAPHIC PROCESSING COMPOSITION HAVING A FIXING ABILITY

This is a continuation of application Ser. No. 07/836,958 filed Feb. 19, 1992, now abandoned.

FIELD OF THE INVENTION

The present invention relates to a process for processing a silver halide photographic material, said process providing excellent fixing properties and also excellent stability of a processing bath containing a fixing agent and the bath subsequent thereto, even in the case of low replenishment processing.

The present invention further relates to an improved fixing or blixing composition for fixing or blixing a silver halide photographic material.

BACKGROUND OF THE INVENTION

Generally, photographic processing of a silver halide color phonographic material comprises a color developing step and a silver removing (desilvering) step. Silver formed by development is oxidizing with a bleaching agent and then dissolved with a fixing agent.

A ferric (III) ion complex salt (e.g., an aminopolycarboxylic acid-iron (III) complex salt) is usually used as the bleaching agent and a thiosulfate is usually used as a fixing agent.

Also, processing of a black and white photographic material comprises a development step and a step of removing unexposed silver halide. Unlike processing of a color photographic material, the black and white photographic material is fixed after development without being bleached. In this case, as the fixing agent, a thiosulfate is usually also used.

Recently, with the development of low replenishing techniques, a more stable liquid composition has been desired for each processing bath. As to a fix bath, since the thiosulfate generally contained therein tends to be deteriorated by oxidation, sulfurized and precipitated; a sulfite is usually added to the fix bath as a preservative for preventing the occurrence of the oxidation. However, with the further development of low replenishing techniques, there is yet a further need for improvement of the stability of each processing liquid. However, such improvement is not attained by an increase in the addition amount of sulfite due to the solubility limit of the sulfite. Furthermore, when the sulfite is oxidized, Glauber's salt is precipitated.

On the other hand, from the view point of promoting rapid photographic processing, the development of a compound having a fixing property superior to thiosulfate has been desired.

In view of the above, there is a need in the art for the development of a fixing agent having excellent stability to oxidation and an excellent fixing property in place of thiosulfate; however such a compound having the above described properties has not hitherto been known.

SUMMARY OF THE INVENTION

A first object of the present invention, therefore, is to provide a fixing process having an excellent fixing property.

A second object of the present invention is to provide a process for processing a silver halide photographic material having improved stability of a processing bath containing a fixing agent and the bath subsequent thereto under conditions of low replenishment processing.

The present inventors have discovered that the foregoing objects can be achieved by the following processing process and processing composition of the present invention.

Namely, in accordance with a first embodiment of the present invention, a process is provided for processing an imagewise exposed silver halide photographic material comprising a support having thereon at least one light-sensitive silver halide emulsion layer, comprising developing in a developing bath and treating in a processing bath having a fixing ability containing at least one compound represented by the following formula (I) as a fixing agent and substantially not containing a thiosulfate ion:

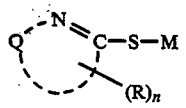

(I)

wherein Q represents an atomic group necessary for forming a 5- or 6-membered heterocyclic ring, which heterocyclic ring may be condensed with a carbon aromatic ring or a hetero-aromatic ring; R represents an alkyl group, an alkenyl group, an aralkyl group, an aryl group or a heterocyclic group each group represented by R being substituted by at least one substituent selected from the group consisting of a carboxyl group or salt thereof, a sulfonic acid group or salt thereof, a phosphonic acid group or salt thereof, an amino group and an ammonium group, or R represents a single bond (wherein the "single bond" means that the carboxylic group or salt thereof, sulfonic acid group or salt thereof phosphonic acid group or salt thereof, amino group, or ammonium group is directly bonded to the heterocyclic ring represented by Q); n represents an integer of from 1 to 3; and M represents a cation group.

According to a second embodiment of this invention, there is provided a photographic processing composition having a fixing ability containing at least one compound represented by above-described formula (I) as a fixing agent and substantially not containing a thiosulfate ion.

DETAILED DESCRIPTION OF THE INVENTION

The present invention is described in detail below.

First, the compound represented by above-described formula (I) is described in detail.

In formula (I), Q preferably represents an atomic group necessary for forming a 5- or 6-membered heterocyclic ring containing carbon and at least one atom selected from a nitrogen atom, an oxygen atom, a sulfur atom and a selenium atom. Furthermore, the heterocyclic ring may be condensed with a carbon aromatic ring or a hereto-aromatic ring.

Examples of the heterocyclic ring include a tetrazole ring, triazole ring, imidazole ring, thiadiazole ring, oxadiazole ring, selenadiazole ring, oxazole ring, thiazole ring, benzoxazole ring, benzothiazole ring, benzimidazole ring, pyrimidine ring, triazaindene ring, tetraazaindene ring, and pentaazaindene ring.

In formula (I), R represents an alkyl group having from 1 to 10 carbon atoms (e.g., methyl, ethyl, propyl, butyl, isopropyl, 2-hydroxypropyl, hexyl, and octyl), an alkenyl group having from 2 to 10 carbon atoms (e.g., vinyl, propenyl and butenyl), an aralkyl group having from 7 to 12 carbon atoms (e.g., benzyl and phenethyl), an aryl group having from 6 to 12 carbon atoms (e.g., phenyl, 2-chlorophenyl, 3-methoxyphenyl, and naphthyl), or a heterocyclic group having from 1 to 10 carbon atoms (e.g., pyridyl, thienyl, furyl, triazolyl, and imidazolyl). Each group represented by R is substituted by at least one substituent selected from a carboxyl group or salt thereof (e.g., a sodium salt, a potassium salt, an ammonium salt, and a calcium salt), a sulfonic acid group or salt thereof (e.g., a sodium salt, a potassium salt, an ammonium salt, a magnesium salt, and a calcium salt), a phosphonic acid group or salt thereof (e.g., a sodium salt, potassium salt, and an ammonium salt), a substituted amino group having from 1 to 10 carbon atoms or unsubstituted amino group (e.g., unsubstituted amino, dimethylamino, diethylamino, methylamino, and bismethoxyethylamino), and a substituted ammonium group having 3 to 12 carbon atoms or unsubstituted ammonium group (e.g., trimethylammonium, triethylammonium, and dimethylbenzylammonium), or R represents a single bond.

Also, R may be a group composed of a combination of the above described alkyl group, alkenyl group, aralkyl group, aryl group, and heterocyclic group (e.g., benzyl, phenethyl, styryl and an alkyl group substituted by a heterocyclic ring) or may contain a linking group selected from —CO—, —CS—, —$SO_2$—, —O—, —S— and —$NR_1$— [wherein $R_1$ represents a hydrogen atom, an alkyl group having from 1 to 6 carbon atoms (e.g., methyl, ethyl, butyl, and hexyl), an aralkyl group having from 7 to 10 carbon atoms (e.g., benzyl and phenethyl), or an aryl group having from 6 to 10 carbon atoms (e.g., phenyl and 4-methylphenyl) and combinations thereof (e.g., —COO—,

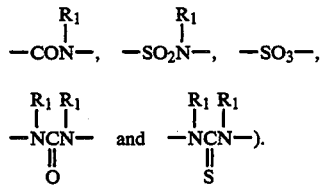

M represents a cation group (e.g., a hydrogen atom, an alkali metal atom such as sodium, potassium, etc.; an alkaline earth metal such as magnesium, calcium, etc.; and an ammonium group such as ammonium, triethylammonium, etc.).

In formula (I), the heterocyclic group represented by Q and each group represented by R may be substituted by a nitro group, a halogen atom (e.g., chlorine and bromine), a mercapto group, a cyano group, a substituted or unsubstituted alkyl group (e.g., methyl, ethyl, propyl, t-butyl, and cyanoethyl), a substituted or unsubstituted aryl group (e.g., phenyl, 4-methanesulfonamidophenyl, 4-methylphenyl, 3,4-dichlorophenyl, and naphthyl), a substituted or unsubstituted alkenyl group (e.g., allyl group), a substituted or unsubstituted aralkyl group (e.g., benzyl, 4-methylbenzyl, and phenethyl), a substituted or unsubstituted sulfonyl group (e.g., methanesulfonyl, ethanesulfonyl, and p-toluenesulfonyl), a substituted or unsubstituted carbamoyl group (e.g., unsubstituted carbamoyl, methylcarbamoyl, and phenylcarbamoyl), a substituted or unsubstituted sulfamoyl group (e.g., unsubstituted sulfamoyl, methylsulfamoyl, and phenylsulfamoyl), a substituted or unsubstituted carbonamido group (e.g., acetamido and benzamido), a substituted or unsubstituted sulfonamido group (e.g., methanesulfonamido, benzenesulfonamido, and p-toluenesulfonamido), a substituted or unsubstituted acyloxy group (e.g., acetyloxy and benzoyloxy), a substituted or unsubstituted sulfonyloxy group (e.g., methanesulfonyloxy), a substituted or unsubstituted ureido group (e.g., unsubstituted ureido group, methylureido, ethylureido, and phenylureido), a substituted or unsubstituted thioureido group (unsubstituted thioureido and methylthioureido), a substituted or unsubstituted acyl group (e.g., acetyl and benzoyl), an oxycarbonylamino group (e.g., methoxycarbonylamino, phenoxycarbonxylamino, and 2-ethylhexyloxycarbonylamino), a hydroxy group, etc.

In formula (I), n represents an integer of from 1 to 3 and when n is 2 or 3, each R group may be the same or different.

In above-described formula (I), Q preferably represents a tetrazole ring, triazole ring, imidazole ring, oxadiazole ring, triazaindene ring, tetraazaindene ring, or pentaazaindene ring; R preferably represents an alkyl group having from 1 to 6 carbon atoms substituted by 1 or 2 substituents selected from a carboxyl group acid or salt thereof and sulfonic acid group or salt thereof; and n preferably represents 1 or 2.

Preferred compounds represented by formula (I) are those shown by the following formula (II):

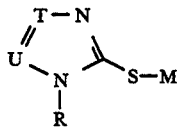

(II)

wherein M and R are defined as in formula (I); T and U each represents C—R′ or N (wherein R′ represents a hydrogen atom, a halogen atom, a hydroxy group, a nitro group, an alkyl group, an alkenyl group, an aralkyl group, an aryl group, a carbonamido group, a sulfonamido group, a ureido group, a thioureido group, or R as defined in formula (I), and when R′ represents R, R′ and R in formula (II) may be the same or different.

The compound represented by formula (II) is described in detail below.

T and U represent C—R′ or N, and R′ represents a hydrogen atom, a halogen atom (e.g., chlorine and bromine), a hydroxy group, a nitro group, an alkyl group having preferably 1 to 10 carbon atoms (e.g., methyl, ethyl, methoxyethyl, n-butyl, and 2-ethylhexyl), an alkenyl group having preferably 2 to 10 carbon atoms (e.g., allyl), an aralkyl group having preferably 7 to 15 carbon atoms (e.g., benzyl, 4-methylbenzyl, phenethyl, and 4-methoxybenzyl), an aryl group having preferably 6 to 15 carbon atoms (e.g., phenyl, naphthyl, 4-methanesulfonamidophenyl, and 4-methylphenyl), a carbonamido group having preferably 1 to 10 carbon atoms (e.g., acetylamino, benzylamino, and methoxypropionylamino), a sulfonamido group having preferably 0 to 10 carbon atoms (e.g., methanesulfonamido, benzenesulfonamido, and p-toluenesulfonamido), a ureido group having preferably 1 to 10 carbon atoms (e.g., unsubstituted ureido, methylureido, and phenylureido), a thioureido group having preferably 1 to 10 carbon atoms (e.g., unsubstituted thioureido, methylthioureido, methoxyethylthioureido, and phenylthioureido), or R as defined in formula (I).

When R′ represents R, R′ may be the same as R in formula (II) or different.

In formula (II), preferably T and U are each N, or T and U are each C—R′ (wherein R′ represents a hydrogen atom or an alkyl group having from 1 to 4 carbon atoms) and R preferably represents an alkyl group having from 1 to 4 carbon atoms substituted by 1 or 2 substituents selected from a carboxyl group or salt thereof and a sulfonic acid group or salt thereof.

Specific examples of the compound represented by formula (I) or (II) for use in this invention are illustrated below, but the invention is not limited to these compounds.

1.

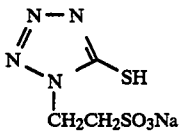

2.

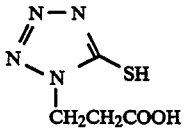

3.

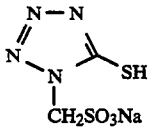

4.

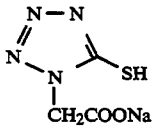

5.

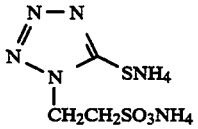

6.

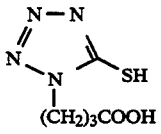

7.

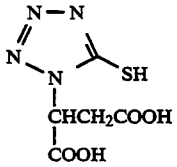

8.

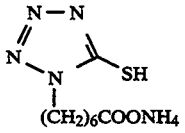

-continued

9.

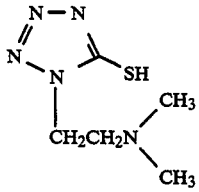

10.

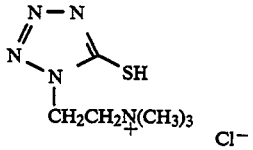

11.

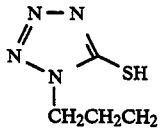

12.

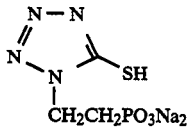

13.

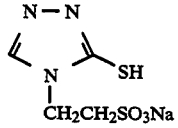

14.

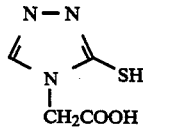

15.

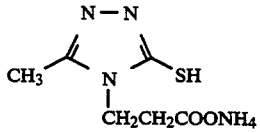

16.

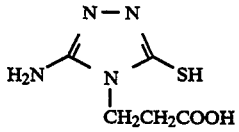

17.

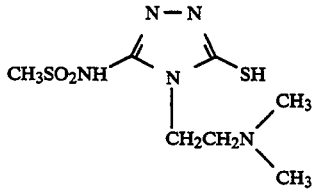

18.

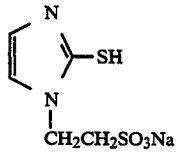

-continued
19.
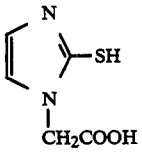
20.
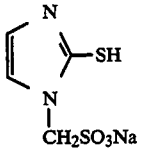
21.
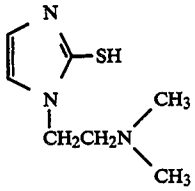
22.
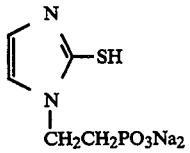
23.
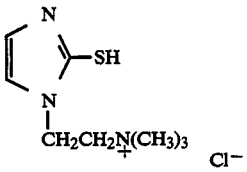
24.
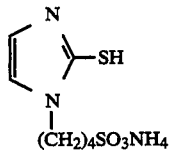
25.
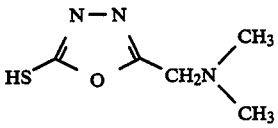
26.
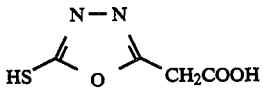
27.
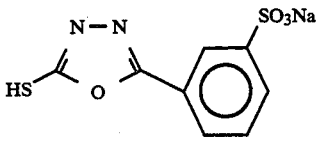
28.
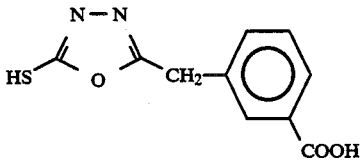
-continued
29.
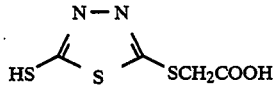
30.
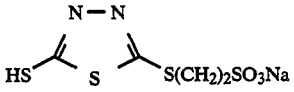
31.
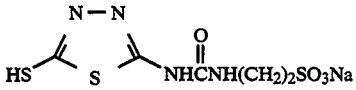
32.
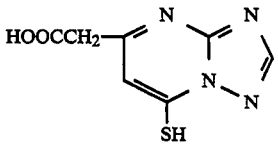
33.
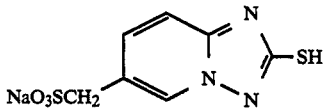
34.
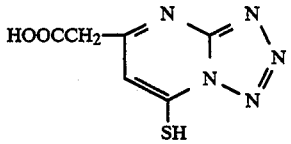
35.
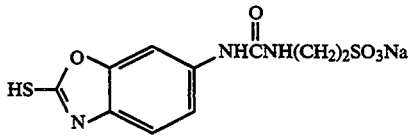
36.
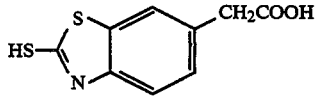
37.
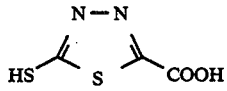
38.
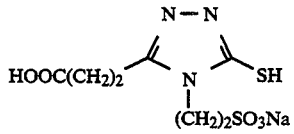
39
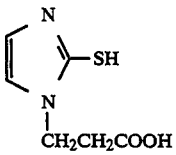
40
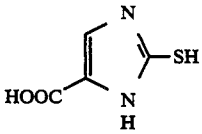

-continued

41

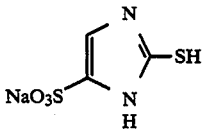

42

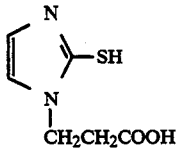

43

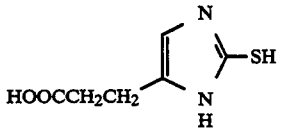

44

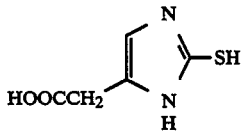

45

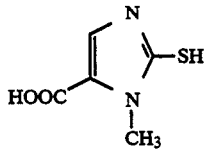

46

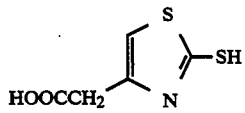

47

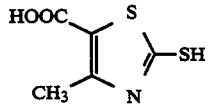

48

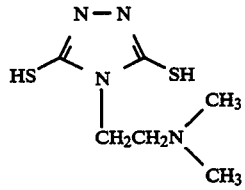

49

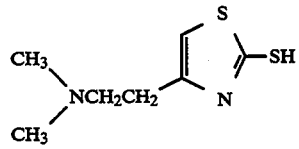

.HCl

50

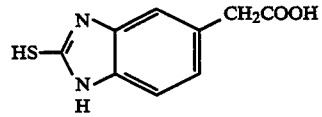

51

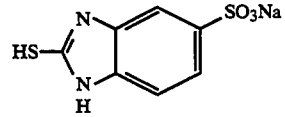

-continued

52

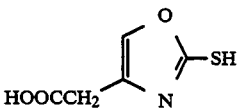

53

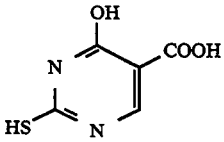

54

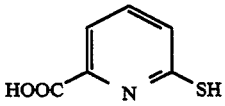

55

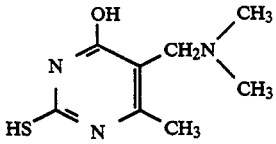

56

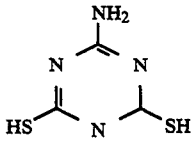

57

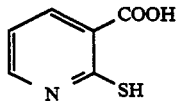

58

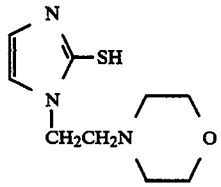

The compounds represented by formulae (I) and (II) for use in this invention can be synthesized according to the methods described in *Berichte der Deutschen Chemischen Gesellschaft,* 28, 77 (1895), JP-A-50-37436, JP-A-51-3231 (the term "JP-A" as used therein means an "unexamined published Japanese patent application"), U.S. Pat. Nos., 2,295,976 and 3,376,310, *Berichte der Deutschen Chemischen Gesellschaft,* 22, 568(1889), ibid., 29, 2483(1896), *Journal of Chemical Society,* 1932, 1806, *Journal of the Americal Chemical Society,* 71, 400(1949), U.S. Pat. Nos. 2,585,388 and 2,541,924, *Advanced in Heterocyclic Chemistry,* 9, 165(1968), *Organic Synthesis,* IV, 569(1963), *Journal of the American Chemical Society,* 45, 2390(1923), *Chemische Berichte,* 9, 465(1876), JP-B-40-28496 (the term "JP-B" as used herein means an "examined published Japanese patent application"), JP-A-50-89034, U.S. Pat. Nos. 3,106,467, 3,420,670, 2,271,229, 3,137,578, 3,148,066, 3,511,663, 3,060,028, 3,271,154, 3,251,691, 3,598,599, and 3,148,066, JP-B-43-4135, U.S. Pat. Nos. 3,615,616, 3,420,664, 3,071,465, 2,444,605, 2,444,606, 2,444,607, and 2,935,404 and also according to the typical synthesis examples shown below.

SYNTHESIS EXAMPLE 1 (SNYTHESIS OF COMPOUND 1)

After adding 100 ml of water to a mixture of 56.8 g of 2-sulfoethyl isocyanate sodium salt and 22.7 g of sodium azide, the resultant mixture was stirred for 4 hours at 70° C. After the reaction was complete, insoluble materials were removed by filtration, the filtrate was evaporated to dryness under reduced pressure, and the solids thus obtained were recrystallized from 400 ml of methanol to provide 45.1 g (yield 64.7%) of the desired product having a melting point of higher than 300° C. The compound obtained was confirmed to be the desired compound (Compound 1) by NMR, mass spectroscopy and elemental analysis.

SYNTHESIS EXAMPLE 2 (SNYTHESIS OF COMPOUND 13)

After adding 230 ml of water to a mixture of 30.0 g of 2-sulfoethyl isothiocyanate sodium salt and 9.6 g of formylhydrazine, the resultant mixture was stirred for 2 hours at room temperature.

Then, 6.3 g of sodium hydroxide was added to the reaction mixture. After refluxing the mixture for 2 hours, 136 ml of concentrated hydrochloric acid was added to the mixture under ice-cooling. The mixture was then evaporated to dryness under reduced pressure, and the solids thus obtained were recrystallized from 50 ml of water to provide 17.6 g (yield 48.2%) of the desired product having a melting point of 269° C. (decomposed).

The compound obtained was confirmed to be the desired compound (Compound 13) by NMR, mass spectroscopy, and elemental analysis.

SYNTHESIS EXAMPLE 3 (SNYTHESIS OF COMPOUND 18)

After adding 100 ml of water to 38.0 g of 2-sulfoethyl isocyanate sodium salt, 26.8 g of aminoacetaldehyde diethylacetal was added dropwise to the mixture under ice-cooling. Thereafter, the mixture was stirred for 3 hours at 60° C. and after adding thereto 40 ml of acetic acid, the resultant mixture was refluxed for 4 hours. After the reaction was completed, the reaction mixture was evaporated to dryness under reduced pressure. The solids obtained were recrystallized from 200 ml of a mixture of methanol and water (3:1 by vol.) to provide 19.0 g (yield 41.2%) of the desired product having a melting point of 274° C. to 275° C.

The compound obtained was confirmed to be desired compound (compound 18) by NMR, mass spectroscopy, and elemental analysis.

The "bath having a fixing ability" for use in this invention includes, for example, a fix bath and a blix bath (bleach-fix bath).

The "photographic processing composition having a fixing ability" for use in this invention includes, for example, a fixing solution used as a fix bath and a blixing solution used as a blix bath.

The compound represented by formula (I) of this invention is contained in a fix bath preferably in an amount of from $1\times10^{-4}$ to 10 mol/liter, more preferably from $1\times10^{-2}$ to 3 mol/liter, and particularly preferably from $2\times10^{-1}$ to 3 mol/liter. Also, the compound represented by formula (I) of this invention is contained in a blix bath in an amount of from $2\times10^{-2}$ to 10 mol/liter, and preferably from $2\times10^{-1}$ to 3 mol/liter.

When the halogen composition of the silver halide emulsion layer in the photographic material for use in this invention comprises silver iodobromide (e.g., the iodide content is not less than 2 mol %, preferably 3 to 15 mol %), the compound represented by formula (I) of this invention is contained in the processing bath in an amount of preferably from 0.5 to 2 mol/liter, and more preferably from 1.2 to 2 mol/liter. When the above-described halogen composition comprises silver bromide, silver chlorobromide or silver halide having a high silver chloride content (e.g., the chloride content is not less than 80 mol %, preferably 90 to 100 mol %, more preferably 95 to 99.5 mol %), the compound represented by formula (I) of this invention is contained in the processing bath in an amount of preferably from $2\times10^{-1}$ to 1 mol/liter.

The term "substantially does not contain a thiosulfate ion" in the composition having a fixing ability of this invention means that the content of the thiosulfate ion (e.g., ammonium thiosulfate) in the composition is less than 0.1 mol/liter more preferably less than 0.05 mol/liter, and particularly preferably less than 0.01 mol/liter. As discussed above, the compound represented by formula (I) of this invention when used in sufficient quantity is alone effective as a fixing agent. In a preferred embodiment, the composition having a fixing ability for use in this invention substantially does not contain any fixing agent other than the compound represented by formula (I). Recently with the development of low replenishment processing in which the replenishment rate is reduced to from ⅓ to 1/10 time that of usual processing, it has been desired to improve the liquid stability of each processing bath. The stability of a fix bath (or blix bath) and a subsequent wash bath is adversely affected by the precipitation of a sulfide formed by the oxidative deterioration of a thiosulfate employed as a fixing agent. The problem also occurs in a wash bath subsequent to the fix or blix bath due to carryover into the wash bath. For preventing precipitation, a sulfite is usually used. However, at low replenishment rates, the foregoing problems are not solved by increasing the sulfite content due to the solubility limit of the sulfite and the formation of Glauber's salt precipitate formed by oxidation of the sulfite.

As the result of various investigations of fixing agents having excellent stability to oxidation which might be used in place of a thiosulfate, the present inventors have discovered that the compound represented by formula (I) of this invention has good fixing ability and is stable to oxidation, and furthermore does not form a precipitate at low replenishing rates. On the other hand, in a blix bath, when a thiosulfate is present together with the compound of formula (I), precipitate forms at low replenishing rates in the blix bath and a subsequent wash bath. The precipitate forms because the oxidizing property of the blix solution itself is considerably higher than that of the fixing solution. However, when the only fixing agent contained in the blix solution is a compound of formula (I) of this invention, good liquid stability is obtained without formation of a precipitate.

Furthermore, the addition of the compound represented by formula (I) of this invention to a wash bath or a stabilization bath subsequent to a bath having a fixing ability is also effective for preventing the formation of a precipitate. The concentration of the compound of formula (I) in the wash bath or stabilization bath is preferably from $10^{-3}$ to 0.5 times that of the fixing agent in the pre-bath thereof i.e., a fix bath or a blix bath.

A silver halide color photographic material and a process for processing the photographic material in accordance with the present invention are described in detail below.

The silver halide color photographic material for processing in accordance with this invention preferably comprises a support having thereon at least one of a blue-sensitive silver halide emulsion layer, a green-sensitive silver halide emulsion layer, and a red-sensitive silver halide emulsion layer. There are no particular restrictions on the number of layers and the arrangement order of the silver halide emulsion layer(s) and light-insensitive layer(s).

A typical example is a silver halide color photographic material comprising a support having thereon on at least one light-sensitive layer comprising plural silver halide emulsion layers each having the same color sensitivity but having a different light-sensitivity. Furthermore, the light-sensitive layer is a unit light-sensitive layer having a color sensitivity to one of blue light, green light, and red light. In a multilayer silver halide color photographic material, such unit light-sensitive layers are generally arranged in the order of a red-sensitive layer, a green-sensitive layer and a blue-sensitive layer, wherein the blue-sensitive layer is arranged farthest from the support. However, depending on the intended application, other arrangement orders of the unit light-sensitive layers can be used. Furthermore, a light-sensitive layer having a different color sensitivity may be arranged between light-sensitive layers having the same color sensitivity.

Also, various light-insensitive layers such as an interlayer, a protective layer, a subbing layer, etc., may be formed between the above described silver halide light-sensitive layers or as the uppermost layer or the lowermost layer of the photographic material.

The interlayer may contain a coupler, DIR compound, etc., as described in JP-A-61-43748, JP-A-59-113438, JP-A-59-113440, JP-A-61-20037, and JP-A-61-20038 or may contain a color mixing inhibitor as generally employed.

As the plural silver halide emulsion layers constituting each unit light-sensitive layer, a two-layer construction of a high-sensitivity silver halide emulsion layer and a low-sensitivity silver halide emulsion layer as described in West German Patent 1,121,470 and British Patent 923,045 is preferably used. Usually, it is preferable to arrange the light-sensitive emulsion layers constituting the unit layer such that the light-sensitivity is successively lowered towards she support. A light-insensitive layer may also be arranged between silver halide emulsion layers. Also, a low-sensitivity emulsion layer may be arranged farther from the support and a high-sensitivity emulsion layer may arranged closer to the support as described in JP-A-57-112751, JP-A-62-200350, JP-A-62-206541, and JP-A-62-206543.

For example, the light-sensitive silver halide emulsion layers can be arranged in the order of a low-sensitivity blue-sensitive layer (BL)/a high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), or in the order of BH/BL/GL/GH/RH/RL, or the order of BH/BL/GH/GL/RL/RH, wherein the last named layer is arranged farthest from the support.

Further, the layers can be arranged in the order, from the side furthest from the support, of blue sensitive layer/GH/RH/GL/RL as disclosed in JP-B-55-34932. Furthermore, the layers can also be arranged in the order, from the side furthest from the support, of blue sensitive layer/GL/RL/GH/RH as disclosed in JP-A-56-25738 and JP-A-62-63936.

Also, a three-layer unit construction comprising a high light sensitivity silver halide emulsion layer as the uppermost layer, a silver halide emulsion layer having a light sensitivity lower than that of the uppermost layer as an intermediate layer, and a silver halide emulsion layer having a light sensitivity lower than that of the intermediate layer can be used, wherein the light sensitivity of these silver halide emulsion layers become successively lower towards the support as described in JP-B-49-15495. In the case of employing a three-layer unit construction of the same color sensitivity, each layer of which having a different light sensitivity, the silver halide emulsion layers may be arranged in the order of an intermediate light-sensitive emulsion layer/a high light-sensitive emulsion layer/a low light-sensitive emulsion layer, wherein the intermediate light-sensitive emulsion layer is farthest from the support as described in JP-A-59-202464.

As described above, various layer structures and layer arrangement orders can be selected depending on the intended application of the color photographic light-sensitive material.

When the silver halide color photographic material is a color negative photographic film or a color reversal photographic film, the silver halide contained in the photographic emulsion layers is preferably silver iodobromide, silver iodochloride, or silver iodochlorobromide each containing less than about 30 mol % of silver iodide. Silver iodobromide or silver iodochlorobromide each containing from about 2 mol % to about 25 mol % silver iodide is particularly preferred.

When the silver halide color photographic material is a color photographic paper, the silver halide contained in the photographic emulsion layers is preferably silver chlorobromide or silver chloride substantially not containing silver iodide. The term "substantially not containing silver iodide" as used herein means that the content of silver iodide is less than 1 mol %, and preferably less than 0.2 mol %. The silver chlorobromide emulsions is not particularly limited with respect to halogen composition and any ratio of silver bromide/silver chloride can be used. The ratio is selected in a wide range depending on the intended purpose, but a silver chlorobromide emulsion containing at least 2 mol % silver chloride is preferably used.

For a silver halide color photographic material adapted for rapid processing, a high silver chloride emulsion having a high silver chloride content is preferably used. The silver chloride content of the high silver chloride emulsion is preferably at least 90 mol %, and more preferably at least 95 mol %. For reducing the amount of the replenisher for the various processing solutions, an almost pure silver chloride emulsion having a silver chloride content of from 98 mol % to 99.9 mol % is also preferably used.

The silver halide grains in the photographic silver halide emulsion may have a regular crystal form such as cubic, octahedral, tetradecahedral, etc., an irregular form such as spherical, tabular, etc., a form having a crystal defect such as twin planes, etc., or may be a composite form thereof.

The silver halide grains may be fine grains having a grain size of less than about 0.2 μm, or as large as about 10 μm calculated as a diameter of the projected area. Also, the silver halide emulsion may be a polydisperse emulsion or a monodisperse emulsion.

The silver halide photographic emulsion for use in this invention can be prepared using the methods described, e.g., in *Research Disclosure* (*RD*), No. 17643 (December, 1978) pages 22 to 23 "Emulsion Preparation and Types" and ibid., No. 18716 (November, 1979), page 648. Also, the monodisperse silver halide emulsions described in U.S. Pat. Nos. 3,574,628 and 3,655,394 and British Patent 1,413,748 are preferably used in this invention.

Also, tabular silver halide grains having an aspect ratio of at least about 5 can be used in this invention. Tabular silver halide grains are readily prepared by the methods described in Gutoff, *Photographic Science and Engineering*, Vol. 14, 248–257(1970), U.S. Pat. Nos. 4,434,226, 4,414,310, 4,433,048, and 4,439,520 and British Patent 2,112,157.

The silver halide grains may have a uniform halogen composition (crystal structure) throughout the grain, or may have a halogen composition that differs between the inside and the surface portion of the grain, or may have a layer structure. Also, the silver halide grains may be epitaxially joined with a silver halide having a different halogen composition or a compound other than silver halide, such as silver rhodanide, lead oxide, etc. Also, a mixture of silver halides each having various crystal forms may be used.

The silver halide emulsion is generally physically ripened, chemically sensitized, and spectrally sensitized prior to use. In the step of physical ripening, various polyvalent metal ion impurities (e.g., salts or complex salts of cadmium, zinc, lead, copper, thallium, iron, ruthenium, rhodium, osmium, palladium, iridium, platinum, etc.) can be introduced into the system.

Examples of the compounds useful for the chemical sensitization are described in JP-A-62-215272, page 18, right under column to page 22, right upper column. Also, additives for use in the above-noted steps are described in *Research Disclosure* (*RD*), No. 17643 and RD, No. 18716 and the corresponding portions are summarized in the following table.

Also photographic additives which can be used in this invention are also described in the foregoing two publications (RD), and the corresponding portions thereof are also shown in the table below.

| Additives | RD 17643 | RD 18716 |
|---|---|---|
| 1. Chemical Sensitizer | Page 23 | Page 648, right column |
| 2. Sensitivity Increasing Agent | | Page 648, right column |
| 3. Spectral Sensitizer and Supersensitizer | Pages 23 to 24 | Page 648, right column |
| 4. Whitening Agent | Page 24 | |
| 5. Antifoggant and Stabilizer | Pages 24 to 25 | Page 649, right column |
| 6. Light-Absorbent, Filter Dye, Ultraviolet Absorbent | Pages 25 to 26 | Page 649, right column to page 650, left column |
| 7. Stain Inhibitor | Page 25, right column | Page 650, left column to right column |
| 8. Dye Image Stabilizer | Page 25 | |
| 9. Hardening Agent | Page 26 | Page 651, left column |
| 10. Binder | Page 26 | Page 650, right column |
| 11. Plasticizer, Lubricant | Page 27 | Page 650, right column |
| 12. Coating Aid, Surface Active Agent | Pages 26 to 27 | Page 650, right column' |
| 13. Static Inhibitor | Page 27 | Page 650, right column |

Also, for preventing the deterioration of photographic performance upon contact with formaldehyde gas, a compound capable of fixing formaldehyde as described in U.S. Pat. Nos. 4,411,987 and 4,435,503 is preferably incorporated into the silver halide color photographic material.

Various color couplers can be contained n the photographic material for processing in accordance with this invention, and practical examples thereof are described in the patents cited in RD, No. 17643, VII-C to G.

Preferred examples of yellow couplers are described in U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649 and European Patent 249,473A.

Preferred magenta couplers include 5-pyrazolone series compounds and pyrazoloazole series compounds, and particularly preferred magenta couplers are described in U.S. Pat. Nos. 4,310,619 and 4,351,897, European Patent 73,636, U.S. Pat. Nos. 3,061,432 and 3,725,064, RD, No. 24220 (June, 1984), RD, No. 24230 (June, 1984), JP-A-60-33552, JP-A-60-43659, JP-A-61-72238, JP-A-60-35730, JP-A-55-118034, and JP-A-60-185951, U.S. Pat. Nos. 4,500,630, 4,540,654, and 4,556,630, WO (PCT) 88/04795.

The cyan couplers include phenol series couplers and naphthol series couplers. Preferred examples of the cyan coupler are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) 3,329,729, European Patents 121,365A and 249,453A, U.S. Pat. Nos. 3,446,622, 4,333,999, 4,753,871, 4,451,559, 4,427,767, 4,690,889, 4,254,212, and 4,296,199 and JP-A-61-42658.

In this invention, a colored coupler for correcting the unnecessary absorption of a colored dye can be used, and preferred examples thereof are described in RD, NO. 17643, VII-G, JP-B-57-39413, U.S. Pat. Nos. 4,163,670, 4,004,929, and 4,138,258, and British Patent 1,146,368.

Also, in this invention, it is preferable so use a coupler for correcting the unnecessary absorption of a colored dye by means of a fluorescent dye released at coupling as described in U.S. Pat. No. 4,774,181 or a coupler having a dye precursor which forms a dye by reacting with a color developing agent as a releasing group as described in U.S. Pat. No. 4,777,120.

In this invention, a coupler forming a colored dye having a proper diffusibility can be used, and preferred examples thereof are described in U.S. Pat. No. 4,366,237, British Patent 2,125,570, European Patent 96,570 and West German Patent Application (OLS) 3,234,533.

Also, in this invention, a polymerized dye-forming coupler can be used, and typical examples thereof are described in U.S. Pat. Nos. 3,451,820, 4,080,211, 4,367,282, 4,409,320, and 4,576,910, and British Patent 2,102,173.

A coupler releasing a photographically useful group upon coupling is preferably used in this invention. Preferred examples of a DIR coupler which releases a development inhibitor are described in the patents cited in RD, 17643, VII-F, JP-A-57-151944, JP-A-57-154234, JP-A-60-184248, and JP-A-63-37346, U.S. Pat. Nos. 4,248,962 and 4,782,012.

Furthermore, in this invention, a coupler which imagewise releases a nucleating agent or a development accelerator upon development can be used, and preferred examples thereof are described in British Patents 2,097,140 and 2,131,188, JP-A-59-157638 and JP-A-59-170840.

Other couplers for use in the silver halide color photographic material in accordance with this invention include competing couplers as described in U.S. Pat. No. 4,130,427, polyequivalent couplers as described in U.S. Pat. Nos. 4,283,472, 4,338,393, and 4,310,618, DIR redox compound-releasing couplers, DIR coupler-releasing couplers, DIR coupler-releasing redox compounds, and DIR redox-releasing redox compounds as described in JP-A-60-185950 and JP-A-62-24252, couplers which release a dye which recolors after being released as described in European Patent 173,302A, bleach accelerator-releasing couplers as described in RD, No. 11449, RD, No.24241, and JP-A-61-201247, ligand-releasing couplers as described in U.S. Pat. No. 4,553,477, couplers releasing a leuco dye as described in JP-A-63-75747, and couplers releasing a fluorescent dye as described in U.S. Pat. No. 4,774,181.

The couplers for use in this invention can be introduced into the silver halide color photographic material by various dispersion methods.

For example, an oil drop-in-water dispersion method can be employed for this purpose, and examples of high-boiling organic solvents for use in the oil drop-in-water dispersion method are described in U.S. Pat. No. 2,322,027.

Useful examples of the high-boiling organic solvent having a boiling point at atmospheric pressure of at least 175° C. for use in the oil drop-in-water dispersion method include phthalic acid esters (e.g., dibutyl phthalate, dicyclohexyl phthalate, di-2-ethylhexyl phthalate, decyl phthalate, bis(2,4-di-t-amylphenyl phthalate, bis(2,4-di-t-amylphenyl) isophthalate, and bis(1,1-diethylpropyl) phthalate), phosphoric acid esters or phosphonic acid esters (e.g., triphenyl phosphate, tricresyl phosphate, 2-ethyl-hexydiphenyl phosphate, tricyclohexyl phosphate, 2-tri-2-ethylhexyl phosphate, tridodecyl phosphate, tributoxyethyl phosphate, trichloropropyl phosphate, and di-2-ethylhexylphenyl phosphonate), benzoic acid esters (e.g., 2-ethylhexyl benzoate, dodecyl benzoate, and 2-ethylhexyl-p-hydroxy benzoate), amides (e.g., N,N-diethyldodecanamide, N,N-diethyllaurylamide, and N-tetradecylpyrrolidone), alcohols or phenols (e.g., isostearyl alcohol and 2,4-di-tert-amylphenol), aliphatic carboxylic acid esters (e.g., bis(2-ethyhaxyl) sebacate, dioctyl azelate, glycerol tributyrate, isostearyl lactate, and trioctyl citrate), aniline derivatives (e.g., N,N-dibutyl-2-butoxy-5-tert-octylaniline), and hydrocarbons (e.g., paraffin, dodecylbenzene, and diisopropylnaphthalene).

Also, as an auxiliary solvent, an organic solvent having a boiling point of at least 30° C., and preferably from about 50° C. to about 160° C. can be used. Typical examples of the auxiliary solvent include ethyl acetate, ethyl propionate, methyl ethyl ketone, cyclohexanone, 2-ethoxyethyl acetate, and dimethylformamide.

Also, a latex dispersion method can be employed for introducing the couplers, and practical examples of the involved steps and effects of the latex dispersion method and useful examples of a latex for impregnation are described in U.S. Pat. No. 4,199,363, West German Patent Applications (OLS) 2,541,274 and 2,541,230.

Moreover, the above described couplers can be emulsion-dispersed in an aqueous solution of a hydrophilic colloid by impregnating a loadable latex polymer (as described, e.g., in U.S. Pat. No. 4,203,716) with the coupler in the presence or absence of the above described high-boiling organic solvent or by dissolving the coupler in a polymer which is insoluble in water but soluble in an organic solvent.

Preferred polymers for use with a coupler include the homopolymers or copolymers described in WO 88/00723, pages 12 to 30. In particular, the use of an acrylamide series polymer is preferred with respect to color image stability, etc.

The process of this invention can be applied to various color photographic materials. Typical examples thereof are general or motion picture color negative photographic films, color reversal photographic films for slide or television, color photographic papers, direct positive color photographic materials, color positive photographic films, and color reversal photographic papers.

Supports for use in the photographic material of this invention are described in RD, No. 17643, page 28 and RD, No 18716, page 647, right column to page 648, left column.

In the silver halide color photographic material for processing in accordance with this invention, the total thickness of the all of the hydrophilic colloid layers on the side having the silver halide emulsion layers is not more than 25 μm, and preferably is not more than 20 μm. The layer swelling speed $T_{\frac{1}{2}}$ is preferably not higher than 30 seconds, and preferably not higher than 15 seconds.

Herein, the layer thickness is measured at 25° C. after storing for 2 days in a controlled environment having a relative humidity of 55%. Also, the layer swelling speed $T_{\frac{1}{2}}$ can be measured by a method known in this field of art. For example, the swelling speed can be measured by using a swellometer of the type described in A. Green et al, *Photographic Science and Engineering*, Vol. 19, No. 2, pages 124–129. $T_{\frac{1}{2}}$ is defined as the time required to reach a saturated layer thickness which: is 90% of the maximum swelled layer thickness attained when processing the color photographic material with a color developer for 3 minutes and 15 seconds at 30° C.

The layer swelling speed $T_{\frac{1}{2}}$ can be controlled by adding a hardening agent to a binder such as gelatin, or by controlling the storage condition after coating. Also, the swelling ratio is preferably from 150% to 400%. The swelling ratio can be calculated from the maximum swelled layer thickness attained under the condition described above according to the following equation:

$$\text{Swelling ratio} = (A-B)/B$$

A: The maximum swelled layer thickness

B: Layer thickness

The silver halide color photographic material for use in this invention can be developed by the process described in RD, No. 17643, pages 28–29 and RD, No. 18716, page 615, left column to right column.

The color developer for use in developing the color photographic material is preferably an alkaline aqueous solution containing an aromatic primary amine color developing agent as a main component. As the color developing agent, an aminophenol series compound is useful but a p-phenylenediamine series compound is preferably used. Typical examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline and the sulfates, hydrochlorides and p-tolyenesulfonates of these compounds. The developing agents can be used alone or in combination thereof.

The color developer generally contains a pH buffer such as a carbonate, borate, or phosphate of an alkali metal, and a development inhibitor or an antifoggant such as a bromide, iodide, benzimidazole, benzothiazole, and mercapto compound. Also, if necessary, the color developer may further contain a preservative such as hydroxylamine, diethylhydroxylamine, sulfite, hydrazines, phenylsemicarbazides, triethanolamine, catecholsulfonic acid, triethylenediamine(1,4-diazabicyclo[2,2,2 ]octanes); an organic solvent such as ethylene glycol, diethylene glycol, etc.; a development accelerator such as benzyl alcohol, polyethylene glycol, quaternary ammonium salts, amines, etc.; a dye-forming coupler; a competing coupler; a fogging agent such as sodium boron hydride, etc.; an auxiliary developing agent such as 1-phehyl-3-pyrazolidone, etc.; a tackifier; a chelating agent such as an aminopolycarboxylic acid, an aminopolyphosphonic acid, an alkylphosphonic acid, and a phosphonocarboxylic acid [e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediaminedi(o-hydroxyphenylacetic acid) and the salts thereof]; a fluorescent whitening agent such as a 4,4'-diamino-2,2'-disulfostilbene series compound, etc.; and a surface active agent such as an alkylsulfonic acid, an arylsulfonic acid, an aliphatic carboxylic acid, an aromatic carboxylic acid, etc.

In the present invention, it is preferable that the color developer contain substantially no benzyl alcohol in view of environmental considerations, liquid preparing properties and color stain inhibition. The term "contains substantially no benzyl alcohol" means that the color developer contains not more than 2 ml of benzyl alcohol per liter of the color developer (more preferably, the color developer contains no benzyl alcohol).

Also, in the case of practicing reversal processing, color development is usually carried out after carrying out black and white development. The black and white developer can contain a known black and white developing agent such as a dihydroxybenzene (e.g., hydroquinone, etc.), a 3-pyrazolidone (e.g., 1-phenyl-3-pyrazolidone), and an aminophenol (e.g., N-methyl-p-aminophenol) used alone or in combination thereof.

The pH of the color developer and the black and white developer is generally from 9 to 12. Also, the amount of the replenisher for the developer is generally not more than 3 liters per $m^2$ of the light-sensitive photographic material being processed. However, the replenishment rate varies depending on the type of color photographic material. The replenisher amount can be reduced to below 500 ml/$m^2$ by reducing the bromide ion concentration in the replenisher. In particular, when using a high silver chloride type color photographic material, it is particularly preferred to reduce bromide ion and to relatively increase chloride ion concentration in the color developer. In this case, the photographic properties and the processing properties are excellent and the variation in photographic properties is readily controlled. The amount of the replenisher for the color developer can then be reduced to about 20 ml/$m^2$ of the color photographic light-sensitive material being developed. When using such a small amount of replenisher, overflow from the color developing bath does not substantially occur.

When using a low replenishing amount, it is preferable to prevent the evaporation and air-oxidation of the processing solution by reducing the contact area of the processing solution with air. Also, by restricting the accumulation of bromide ion in the developer, the amount of the developer replenisher can be reduced.

The processing temperature of the color developer for use in this invention is from 20° C. to 50° C., and preferably from 30° C. to 45° C. The processing time is from 20 seconds to 5 minutes, and preferably from 30 seconds to 3 minutes. By increasing the processing temperature and pH of the developer and by using a color developer containing a developing agent in high concentration, the processing time can be further reduced.

The photographic emulsion layers are generally bleached after color development. The bleach process may be carried out simultaneously with a fix process (bleach-fix or blix) or may be carried out separately from the fix process. Furthermore, for increasing the processing speed, a blix processing may be carried out after bleach processing. Moreover, a process of processing in a second blix bath immediately following a first blix bath, a process of fixing before blix processing, or a process of bleaching after blix processing can be practiced according to the intended purpose.

The processing temperature of the bleach solution and blix solution is from 20° C. to 50° C., and preferably form 30° C. to 45° C. The processing time is from 20 seconds to 5 minutes, and preferably form 30 seconds to 4 minutes.

As bleaching agents, for example, compounds of a multivalent metal such as iron(III), cobalt(III), chromium(IV), copper(II), etc., peracids, quinones, and nitro compounds can be used.

Useful examples of the bleaching agent include ferricyanides; bichromates; organic complex salts of iron(III) or cobalt(III), such as, for example, the complex salts of aminopolycarboxylic acids suck as ethylenediaminetetraacetic acid, diethylenetriaminopentaacetic acid, cyclohexanediaminetetraacetic acid, methyliminodiacetic acid, 1,3-diaminopropanetetraacetic acid, glycol ether diaminetetraacetic acid, etc., or citric acid, tartaric acid, malic acid, etc.; persulfates; bromate; permanganates; nitrobenzenes, etc.

Of these bleaching agents, the aminopolycarboxylic acid iron(III) complex salts such as an ethylenediaminetetraacetic acid iron(III) complex salt, etc., and persulfates are preferred for rapid processing and in view of environmental factors. Furthermore, the aminopoiycarboxylic acid iron(III) complex salts are particularly useful in both a bleach solution and a blix solution. In particular, in a bleach solution for processing a color photographic negative film for in camera use, 1,3-diaminopropanetetraacetic acid iron(III) complex salts are preferred in view of their bleaching ability. The pH of the bleach solution or the blix solution containing an aminopolycarboxylic acid iron(III) complex salt is generally from 5.5 to 8, but the processing solution may have lower pH to speed up processing process. The amount of the bleaching agent to be added to the bleach solution or blix solution is preferably from 0.05 to 1 mol/liter.

For the bleach solution, the blix solution and the pre-bath thereof, if necessary, a bleach accelerator can be added thereto.

Examples of useful bleach accelerators are the compounds having a mercapto group or a disulfide group described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, RD, No. 17129 (July, 1978), etc.; the thiazolidine derivatives described in JP-A-50-140129; the thiourea derivatives described in JP-B-45-8506, JP-A-52-20832, JP-A-53-32735, U.S. Pat. No. 3,706,561, etc.; the iodides described in West German Patent 1,127,715, JP-A-58-16235, etc.; the polyoxyethylene compounds described in West German Patents 966,410 2,748,430, etc.; the polyamine compounds described in JP-B-45-8836, etc.; the compounds described in JP-A-49-42434, JP-A-49-59644, JP-A-53-94927, JP-A-54-35727, JP-A-55-26506, JP-A-58-163940, etc.; and bromide ion.

Of these bleach accelerators, the compounds having a mercapto group or a disulfide group are preferred for providing a large accelerating effect, and the compounds described in U.S. Pat. No. 3,893,858, West German Patent 1,290, 812, and JP-A-53-95630 are particularly preferred. Further, the compounds described in U.S. Pat. No. 4,552,834 are also preferred. The amount of the bleach accelerators to be added to the bleach solution or blix solution is preferably $1\times10^{-4}$ to $1\times10^{-2}$mol/liter, more preferably $1\times10^{-4}$ to $1\times10^{-3}$ mol/liter. The bleach accelerators may also be added to the color photographic light-sensitive material. In the case blixing a color photographic material for in camera use, the above described bleach accelerators are particularly effective.

The blix solution for use in this invention can contain known additives, e.g., a rehalogenating agent such as ammonium bromide, ammonium chloride, etc., a pH buffer such as ammonium nitrate, etc., and a metal corrosion inhibitor such as ammonium sulfate, etc.

The fix bath of this invention may contain a known fixing agent other than a thiosulfate ion in addition to the compound represented by formula (I).

Examples of known fixing agents for use in this invention include thiocyanates, thioether series compounds, thioureas, and iodide in large quantity. The amount of the known fixing agents is approximately the same as that of the compound represented by formula (I). The known fixing agents may be used in any ratio with the compound represented by formula (I).

The blix solution of this invention may contain a preservative such as a sulfite, a bisulfite, a carbonyl-bisulfite addition product, and a sulfinic acid compound.

Also, the fix solution of this invention preferably contains an aminopolycarboxylic acid or an organic phosphonic acid series chelating agent (such as, preferably, 1-hydroxyethilidene-1,1-diphosphonic acid and N,N,N',N'-ethylenediaminetetraphosphonic acid) for improving the stability of the fix solution.

The processing temperature of the fix solution is from 20° C. to 50° C., and preferably form 30° C. to 45° C. The processing time is from 20 seconds to 5 minutes, and preferably form 30 seconds to 4 minutes.

The fix solution can further contain various fluorescent whitening agents, defoaming agents, surface active agents, polyvinylpyrrolidone, methanol, etc.

For shortening-the desilvering processing time, vigorous stirring of each processing solution in the desilvering step is preferably carried out. Useful stirring means include the methods described in JP-A-62-183460 and JP-A-62-183461. In the case of applying a jet stream as the stirring means, the jet stream is preferably applied within 15 seconds after introducing the color photographic material into the processing solution.

In this invention, the crossover time from a color developer to a bleach solution (i.e., the time that it takes for a color photographic material to leave the color developer and enter the bleach solution) is preferably 10 seconds or less for improving the bleach fog and to minimize staining of the surface of the color photographic material being processed. Also, the crossover time from the bleach solution to the processing solution having a fixing ability in this invention is preferably 10 seconds or less for improving the inferior recoloring of cyan dyes.

The replenishing amount for the fix solution is preferably from 300 to 800 ml/m$^2$ in the case of a color photographic light-sensitive material for in camera use (e.g., coated silver amount of from 4 to 12 g/m$^2$), and the replenishing amount for the blix solution is preferably from 20 to 50 ml/m$^2$.

The silver halide color photographic material for processing in accordance with this invention is generally subjected to a wash step and/or a stabilization step after desilvering processing.

The amount of wash water in the wash step can be selected in a wide range depending on the characteristics (e.g., materials being used, such as couplers, etc.) of the color photographic material being processed, the use thereof, the temperature of the wash water, the number of wash tanks (stage numbers), the replenishing system such as a counter-current system, a regular current system, etc., and other various conditions. Among these conditions, the relationship of the number of wash tanks and the amount of wash water in a multistage counter-current system can be obtained by the method described in *Journal of the Society of Motion Picture and Television Engineering*, Vol. 64, 248–253 (May, 1955).

In accordance with the multistage counter-current system described in the above publication, the amount of wash water can be greatly reduced. However, the increase in residence time of water in the tanks results in the proliferation of bacteria which float and adhere to the color photographic material. In the processing of a color photographic material in accordance with this invention, effective means for solving the foregoing problems include a method of reducing Ca ion and Mg ion as described in JP-A-62-288838. Chlorine series germicides such as the isothiazolone compounds described in JP-A-57-8542, thiabendazole, chlorinated sodium isocyanurate, etc., other benzotriazoles, and other germicides described in Hiroshi Horiguchi, *Bookin Boobai no Kaqaku* (*Chemistry of Antibacterial and Antifungal Agents*), *Biseibutsu no Mekkin, Sakkin, Boo-*

*bai Gijutsu* (*Germicidal and Fungicidal Techniques of Microorganisms*), edited by Eiseigijutsu Kai, and *Bookin Boobaizai Jiten* (*Handbook of Germicidal and Fungicidal Agents*), edited by Nippon Bookin Boobai Gakkai can also be used in this invention.

The pH of wash water in the processing of a color photographic material in accordance with this invention is from 4 to 9, and preferably from 5 to 8. The temperature and the time of water washing is selected depending on the characteristics and the use of the color photographic material being processed, but is generally in the range of from 15° C. to 45° C. and from 20 seconds to 10 minutes, and preferably from 25° C. to 40° C. and from 30 seconds to 5 minutes. Furthermore, in the process of this invention, a stabilization step can be directly applied in place of the above noted wash step. For the stabilization step, all of the processes described in JP-A-57-8543, JP-A-58-14834, and JP-A-60-220345 can be used.

In some circumstances, the stabilization process may be further conducted after the wash processing. For example, a stabilization bath containing a dye stabilizer such as formalin, hexamethylenetetramine, hexahydrotriazine, and an N-methylol compound can be used as a final bath for processing of color photographic materials for in camera use. If necessary, the stabilization bath can contain ammonium compounds, metal compounds of Bi, Al, etc., fluorescent whitening agents, various chelating agents, film pH controlling agents, a hardening agent, germicides, fungicides, alkanoiamine, and surface active agents (preferably silicone series surfactants).

As the water for use in the wash step and the stabilization step, city water, water subjected to a deionizing treatment by an ion exchange resin to reduce the Ca ion concentration and the Mg ion concentration below 5 mg/liter, or water sterilized by a halogen or a ultraviolet sterilizing lamp is preferably used.

The replenishing amount for the above described wash step and/or the stabilization step is from 1 to 50 times, preferably from 2 to 30 times, and more preferably from 2 to 15 times the amount of the processing solution carried over from the pre-bath per unit area of the color photographic material being processed. The overflow liquid obtained with replenishing can be reused for the desilvering step and other steps.

The silver halide color photographic material for processing in accordance with this invention may contain a color developing agent to simplify and accelerate the processing. When contained in the color photographic material, a precursor of the color developing agent is preferably used. For example, useful developing agent precursors include the indoaniline type compounds described in U.S. Pat. No. 3,342,597, the Schiff base type compounds described in U.S. Pat. No. 3,342,599, RD, No. 14850, and RD, No. 15159, the metal complexes described in U.S. Pat. No. 3,719,492, and the urethane series compounds described in JP-A-53-135628.

The silver halide color photographic material for processing in accordance with this invention may contain various 1-phenyl-3-pyrazolidones for accelerating the color development. Typical compounds are described in JP-A-56-64339, JP-A-57-144547, and JP-A-58-115438.

The various processing solutions in this invention are generally used at a temperature of from 10° C. to 50° C. A temperature of from 33° C. to 38° C. is generally employed, but the processing time can be shortened by employing a higher temperature. On the other hand, improvement of image quality and improvement of the stability of the processing solutions can be attained by employing a lower processing temperature.

An example of a silver halide color photographic material for use in this invention is a direct positive silver halide color photographic material. A process for processing a direct positive silver halide color photographic material in accordance with this invention is described below.

After imagewise exposure of the sliver halide color photographic material, direct positive color images are formed preferably by color developing with a surface developer containing an aromatic primary amine color developing agent having pH of not higher than 11.5. The photographic material is subjected to a fogging treatment during or following color development with light or a nucleating agent, and the fogging treatment is followed by bleaching and fixing. The pH of the surface developer is preferably in the range of from 11.0 to 10.0.

For the fogging treatment in accordance with this invention, a "light fogging method" (i.e., a method of applying a secondary exposure to the whole surface of the light-sensitive emulsion layers) or a "chemical fogging method" (i.e., a method of developing in the presence of a nucleating agent) may be used. Furthermore, the color photographic material may be developed in the presence of a nucleating agent and fogging light. Also, the color photographic material containing a nucleating agent may be subjected to a fogging exposure.

The light fogging method is described in Japanese Patent Application No. 61-253716, page 47, line 4 to page 49, line 5 and a nucleating agent which can be used in this invention is described in the same patent application, page 49, line 6 to page 67, line 2. In particular, the use of the compounds shown by general formulae (N-1) and (N-2) described in Japanese Patent Application No. 61-253716 is preferred. Specific examples of the preferred nucleating agent are (N-I-1) to (N-I-10) described in the above noted patent application, page 56 to page 58, and (N-II-1) to (N-II-12) described at pages 63 to 66.

Nucleation accelerators for use in this invention are described in the foregoing Japanese Patent Application No. 61-253716, page 68, line 11 to page 71, line 3. The nucleation accelerators (A-1) to (A-13) described in the above noted patent application, pages 69 to 70, are particularly preferred.

A silver halide black and white photographic material and method for processing thereof in accordance with this invention are described below.

There is no particular restriction on the halogen composition of the light-sensitive silver halide emulsion. Silver chloride, silver chlorobromide, silver iodobromide, silver bromide, silver iodobromochloride, etc., can be used, but the silver iodide content is preferably not more than 10 mol %, and particularly preferably not more than 5 mol %.

For the formation of a negative image having high contrast, the mean grain size of the silver halide grains is preferably not larger than 0.7 μm, and is particularly preferably not larger than 0.5 μm.

There is no particular restriction with respect to grain size distribution of the silver halide grains, but a monodisperse silver halide emulsion is preferred.

The term "monodisperse" means that at least 95% by weight or grain number of the silver halide grains have grain sizes within ±40% of the mean grain size.

The silver halide grains of the silver halide photographic emulsion may have a regular crystal form such as cubic, octahedral, rhombic dodecahedral, tetradecahedral, etc., an irregular crystal form such as spherical, tabular, etc., or a composite form of these crystal forms.

With regard to other aspects of the silver halide photographic emulsion, the above description regarding silver halide photographic emulsions for use in a photographic material are generally applicable.

The silver halide emulsion layer of a photographic material for use in this invention preferably contains two kinds of monodisperse silver halide emulsions each having a different mean grain size as described in JP-A-61-223734 and JP-A-62-90646 for the purpose of increasing the maximum density (Dmax). In this case, the monodisperse silver halide grains having a smaller grain size is preferably chemically sensitized. Sulfur sensitization is most preferred. The monodisperse silver halide emulsion having a larger grain size may or may not be chemically sensitized. The large grain size monodisperse silver halide emulsion is generally not subjected to chemical sensitization; otherwise black pepper tends to occur. Thus, if the larger grain size monodisperse silver halide emulsion is to be chemically sensitized, a low degree of chemical sensitization is preferred to the extent that black pepper is not formed. In this case, the low degree of chemical sensitization is conducted by the means that the time of subjecting the emulsion to chemical sensitization is shortened as compared with the chemical sensitization for the small grain size monodisperse silver halide emulsion, the temperature during chemical sensitization is lowered as compared to that for the smaller grain monodisperse emulsion, or a reduced amount of chemical sensitizer is added.

There is no particular restriction on the sensitivity difference of the larger size monodisperse emulsion and the smaller size monodisperse emulsion, but the sensitivity difference is from 0.1 to 1.0, and preferably from 0.2 to 0.7 as $\Delta\log E$. Preferably, the larger size monodisperse emulsion has a higher sensitivity. The mean grain size of the smaller size monodisperse silver halide grains is less than about 90%, and preferably less than about 80% of the mean grain size of the larger size monodisperse silver halide grains.

In a light-sensitive material for printing for use in this invention, an image having a super high contrast can be formed by incorporating a nucleating agents into the photographic emulsion layer or other hydrophilic colloid layer. Examples of useful nucleating agents include those described in RD, No. 23516 (November, 1983), page 346 and the various literature cited therein.

Compounds effective for use as a development accelerator or as an accelerator for a nucleating infectious development for use in this invention include the compounds disclosed in JP-A-53-77616, JP-A-54-37732, JP-A-53-137133, JP-A-60-140340, and JP-A-60-14959, and various compounds containing N or S.

The direct positive photographic light-sensitive material for use in this invention may contain a desensitizer in the photographic silver halide emulsion layer(s) and other hydrophilic colloid layers. The organic desensitizer for use in this invention is defined by the polarographic half wave potential, namely, the oxidation reduction potential determined by polarography, wherein the sum of the polaro anodic potential and the cathodic potential becomes positive.

As the organic desensitizer, the compounds shown by general formulae (III) to (V) described in Japanese Patent Application No. 61-280998, pages 55 to 72 are preferably used.

The developer for developing the silver halide black and white photographic material in accordance with this invention can contain generally employed additives (e.g., a developing agent, an alkali agent, a pH buffer, a preservative, and a chelating agent). For processing in accordance with this invention, known processes can be used. Furthermore, the processing solutions of this invention may contain known additives generally employed in black and white developers. The processing temperature is generally selected in the range of from 18° C. to 50° C. but a temperature lower than 18° C. or a temperature higher than 50° C. may be employed. The processing time is from 10 seconds to 3 minutes, and preferably from 10 seconds to 1 minute.

For the black and white developer, known developing agents such as dihydroxybenzenes (e.g., hydroquinone), 1-phenyl-3-pyrazolidones, aminophenols (e.g., N-methyl-p-aminophenol), etc., can be used alone or in combination thereof.

The dihydroxybenzene series developing agent is preferably used in an amount of from 0.05 mol/liter to 0.8 mol/liter. Also, in the case of using a combination of a dihydroxybenzene and a 1-phenyl-3-pyrazolidone or a p-aminophenol, it is preferred that the former is used in an amount of 0.05 mol/liter to 0.5 mol/liter and the latter is used in an amount of not more than 0.06 mol/liter.

Sulfite preservatives for use in this invention include sodium sulfite, potassium sulfite, lithium sulfite, sodium bisulfite, potassium metabisulfite and formaldehyde sodium bisulfite.

For the black and white developer, and especially a developer for graphic art, a sulfite is added in an amount of at least 0.3 mol/liter. However, if the sulfite content is to high, the sulfite precipitates in the developer to cause a liquid stain. Hence, sulfite is preferably contained in an amount of not more than 1.2 mol/liter.

The alkali agent contained in the developer for use in this invention includes pH controlling agents and buffers such as sodium hydroxide, potassium hydroxide, sodium carbonate, potassium carbonate, sodium tertiary phosphate, potassium tertiary phosphate, sodium silicate, potassium silicate, etc.

Also, other useful additives contained in the black and white developer include development inhibitors such as boric acid, borax, sodium bromide, potassium bromide, potassium iodide, etc.; organic solvents such as ethylene glycol, diethylene glycol, triethylene glycol, dimethylformamide, methylcellosolve, hexylene glycol, ethanol, methanol, etc.; antifoggants or black pepper inhibitors such as mercapto series compounds (e.g., 1-phenyl-5-mercaptotetrazole and sodium 2-mercaptobenzimidazole), indazole series compounds (e.g., 5-nitroindazole), benztriazole series compounds (e.g., 5-methylbenztriazole), etc., and further if necessary, the developer may contain a toning agent, a surface active agent, a defoaming agent, a water softener, a hardening agent, etc. Also, as a silver stain inhibitor, the compounds described in JP-A-56-24347 can be used. Also, to prevent uneven development, the compounds described in JP-A-62-212651 can be used. Furthermore, as a dissolution aid, the compounds described in Japanese Patent Application No. 60-109743 can be used.

The developer for use in this invention can contain boric acid as described in JP-A-62-186259, saccharide (e.g., saccharose), oximes (e.g., acetoxime), phenols (e.g., 5-sulfosalicylic acid), and tertiary phosphates (e.g., the sodium salts and potassium salts) as described in JP-A-60-93433.

The fix solution for use in this invention is an aqueous solution containing, if necessary, a hardening agent (e.g., water-soluble aluminum compounds), acetic acid, and a dibasic acid (e.g., tartaric acid, citric acid and the salts thereof) in addition to the fixing agent. The fix solution preferably has a pH of higher than 3.8, and is preferably from 4.0 to 7.5.

A water-soluble aluminum compound can be used in the fix solution as a hardening agent to provide an acidic hardening fix solution. Examples thereof include aluminum chloride, aluminum sulfate, and aluminum alum.

Also, as the foregoing dibasic acid, tartaric acid or derivatives thereof and citric acid or derivatives thereof can be used alone or in combination thereof. The effective amount of the compound is at least 0.005 mol per liter of the fix solution, and particularly from 0.01 mol/liter to 0.03 mol/liter. Useful examples thereof include tartaric acid, potassium tartarate, sodium tartarate, sodium potassium tartarate, ammonium tartarate, and potassium ammonium tartarate.

If necessary, the fix solution may further contain a preservative (e.g., sulfite and hydrogensulfite), a pH buffer (e.g., acetic acid and boric acid), a pH controlling agent (e.g., ammonia and sulfuric acid), an image storage improving agent (e.g., potassium iodide), and a chelating agent.

In this case, the pH buffer is used in an amount of from 10 g/liter to 40 g/liter, and more preferably from about 18 g/liter to 25 g/liter because the pH of the developer is relatively high.

The fixing temperature and time are the same as those for the development and are preferably from about 20° C. to about 50° C. and from 10 seconds to 1 minute. The replenishing amount for the fix solution is preferably from 50 to 300 ml/m$^2$.

Also, the above described wash water for processing can be used. Also, a stabilization solution may be used in place of wash water.

In this invention, the roller transporting type automatic processor described in U.S. Pat. Nos. 3,025,779 and 3,545,971 can be used. The processor is simply referred to herein as a roller transport type processor.

The roller transport type processor is composed of 4 steps of development, fix, wash, and drying. It is most preferable that the processing employ these 4 steps, although other steps (e.g., a stop step) are not excluded. In this case, in the wash step, water consumption can be reduced by using a counter-current wash step of from 2 to 3 stages.

The black and white photographic light-sensitive material for processing in accordance with this invention include an ordinary black and white silver halide photographic material (e.g., black and white photographic paper for in camera use, an X-ray black and white photographic material, and a printing black and white light-sensitive material), an infrared photographic light-sensitive material for laser scanner, etc.

Use of the compound of formula (I) of this invention improves stability (in particular, sulfurization, etc., is prevented) of a fix solution or a fix solution having a bleaching ability (e.g., a blix solution), and a processing composition having a good fixing ability is obtained.

Also, by using the compound of formula (I) of this invention, stable processing is achieved even when the replenishing amount for the fix solution or the blix solution is greatly reduced.

The invention is further described in reference to the following Examples, but the invention is not limited thereby.

EXAMPLE 1

A multilayer color photographic material (sample 101) was prepared by forming the layers having the following compositions on a cellulose triacetate film support having a subbing layer. (Compositions of Layers)

The coating amounts are shown in terms of the unit g/m$^2$ of silver for a silver halide emulsion and colloidal silver, the unit g/m$^2$ for couplers, additives and gelatin, and the unit mol number per mol of the silver halide contained in the same layer for a sensitizing dye.

| | |
|---|---|
| Layer 1 (Antihalation Later) | |
| Black Colloidal Silver | 0.15 |
| Gelatin | 1.5 |
| ExM-8 | 0.08 |
| UV-1 | 0.03 |
| UV-2 | 0.06 |
| Solv-2 | 0.08 |
| UV-3 | 0.07 |
| Cpd-5 | $6 \times 10^{-4}$ |
| Layer 2 (Interlayer) | |
| Gelatin | 1.5 |
| UV-1 | 0.03 |
| UV-2 | 0.06 |
| UV-3 | 0.07 |
| ExF-1 | 0.004 |
| Solv-2 | 0.07 |
| Cpd-5 | $6 \times 10^{-4}$ |
| Layer 3 (1st Red-Sensitive Emulsion Layer) | |
| Silver Iodobromide Emulsion (AgI 2 mol %, high internal AgI type, sphere-corresponding diameter 0.3 μm, variation coeff. of sphere-corresponding diameter 29%, normal crystal and twin crystal mixed grains, aspect ratio 2.5) | 0.5 |
| Gelatin | 0.8 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.22 |
| ExC-4 | 0.02 |
| Cpd-5 | $3 \times 10^{-4}$ |
| Layer 4 (2nd Red-Sensitive Emulsion Layer) | |
| Silver Iodobromide Emulsion (AgI 4 mol %, high internal AgI type, sphere-corresponding diameter 0.55 μm, variation coeff. of sphere-corresponding diameter 20%, normal crystal and twin crystal mixed grains, aspect ratio 1) | 0.7 |
| Gelatin | 1.26 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.33 |
| ExC-4 | 0.01 |
| ExY-16 | 0.01 |
| ExC-7 | 0.04 |
| ExC-2 | 0.08 |
| Solv-1 | 0.03 |
| Cpd-5 | $5 \times 10^{-4}$ |
| Layer 5 (3rd Red-Sensitive Emulsion Layer) | |
| Silver Iodobromide Emulsion (AgI 10 mol %, high internal AgI type, sphere-corresponding diameter 0.7 μm, variation coeff. of sphere-corresponding diameter 30%, normal crystal and twin crystal mixed grains, aspect ratio 2) | 0.7 |

-continued

| | |
|---|---|
| Gelatin | 0.8 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.06 |
| Solv-1 | 0.15 |
| Solv-2 | 0.08 |
| Cpd-5 | $3 \times 10^{-5}$ |
| Layer 6 (Interlayer) | |
| Gelatin | 1.0 |
| Cpd-5 | $4 \times 10^{-4}$ |
| Cpd-1 | 0.10 |
| Cpd-4 | 1.23 |
| Solv-1 | 0.05 |
| Cpd-3 | 0.25 |
| Layer 7 (1st Green-Sensitive Emulsion Layer) | |
| Silver Iodobromide Emulsion (AgI 2 mol %, high internal AgI type, sphere-corresponding diameter 0.3 μm, variation coeff. of sphere-corresponding diameter 28%, normal crystal-twin crystal mixed grains, aspect ratio 2.5) | 0.30 |
| Gelatin | 0.4 |
| ExS-4 | $5 \times 10^{-4}$ |
| ExS-6 | $0.3 \times 10^{-4}$ |
| ExS-5 | $2 \times 10^{-4}$ |
| ExM-9 | 0.2 |
| ExY-14 | 0.03 |
| ExY-8 | 0.03 |
| Solv-1 | 0.2 |
| Cpd-5 | $2 \times 10^{-4}$ |
| Layer 8 (2nd Green-Sensitive Emulsion Layer) | |
| Silver Iodobromide Emulsion (AgI 4 mol %, high internal AgI type, sphere-corresponding diameter 0.55 μm, variation coeff. of sphere-corresponding diameter 20%, normal crystal-twin crystal mixed grains, aspect ratio 4) | 0.6 |
| Gelatin | 0.8 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.04 |
| Solv-1 | 0.2 |
| Cpd-5 | $3 \times 10^{-4}$ |
| Layer 9 (3rd Green-Sensitive Emulsion Layer) | |
| Silver Iodobromide Emulsion (AgI 10 mol %, high internal AgI type, sphere-corresponding diameter 0.7 μm, variation coeff. of sphere-corresponding diameter 30%, normal crystal-twin crystal mixed grains, aspect ratio 2.0) | 0.85 |
| Gelatin | 1.0 |
| ExS-4 | $2.0 \times 10^{-4}$ |
| ExS-5 | $2.0 \times 10^{-4}$ |
| ExS-6 | $0.2 \times 10^{-4}$ |

-continued

| | |
|---|---|
| ExS-7 | $3.0 \times 10^{-4}$ |
| ExM-12 | 0.06 |
| ExM-13 | 0.02 |
| ExM-8 | 0.02 |
| Solv-1 | 0.20 |
| Solv-2 | 0.05 |
| Cpd-5 | $4 \times 10^{-4}$ |
| Layer 10 (Yellow Filter Layer) | |
| Gelatin | 0.9 |
| Yellow Colloidal Silver | 0.05 |
| Cpd-1 | 0.2 |
| Solv-1 | 0.15 |
| Cpd-5 | $4 \times 10^{-4}$ |
| Layer 11 (1st Blue-Sensitive Emulsion Layer) | |
| Silver Iodobromide Emulsion (AgI 4 mol %, high internal AgI type, sphere-corresponding diameter 0.5 μm, variation coeff. of sphere-corresponding diameter 15%, octahedral grains) | 0.4 |
| Gelatin | 1.0 |
| ExS-8 | $2 \times 10^{-4}$ |
| ExY-16 | 0.9 |
| ExY-14 | 0.09 |
| Solv-1 | 0.3 |
| Cpd-5 | $4 \times 10^{-4}$ |
| Layer 12 (2nd Blue-Sensitive Emulsion Layer) | |
| Silver Iodobromide Emulsion (AgI 10 mol %, high internal AgI type, sphere-corresponding diameter 1.3 μm, variation coeff. of sphere-corresponding diameter 25%, normal crystal-twin crystal mixed grains, aspect ratio 4.5) | 0.5 |
| Gelatin | 0.6 |
| ExS-8 | $1 \times 10^{-4}$ |
| ExY-16 | 0.12 |
| Solv-1 | 0.04 |
| Cpd-5 | $2 \times 10^{-4}$ |
| Layer 13 (1st Protective Layer) | |
| Fine Grain Silver Iodobromide (mean grain size 0.07 μm, AgI 1 mol %) | 0.2 |
| Gelatin | 0.8 |
| UV-3 | 0.1 |
| UV-4 | 0.1 |
| UV-5 | 0.2 |
| Solv-3 | 0.04 |
| Cpd-5 | $3 \times 10^{-4}$ |
| Layer 14 (2nd Protective Layer) | |
| Gelatin | 0.9 |
| Polymethyl Methacrylate Particles (diameter 1.5 μm) | 0.2 |
| Cpd-5 | $4 \times 10^{-4}$ |
| H-1 | 0.4 |

Each layer further contained a surface active agent as a coating aid in addition to the above components.

The chemical structural formulae or chemical names of the compounds used to prepare the photographic material are shown below.

UV-4

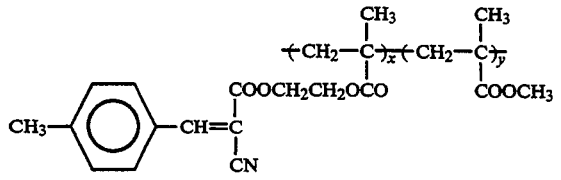

x/y = 7/3 (by weight ratio)

UV-5

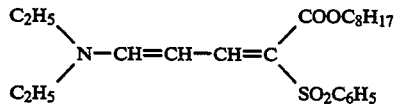

-continued
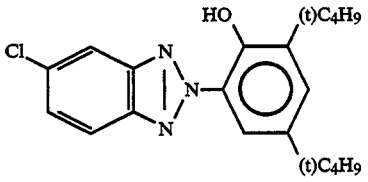
UV-1
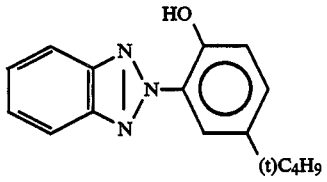
UV-2
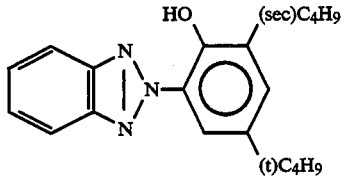
UV-3
Solv-1: Tricresyl Phosphate
Solv-2: Dibutyl Phthalate
Solv-3: Bis(2-ethylhexyl) Phthalate
ExM-8:
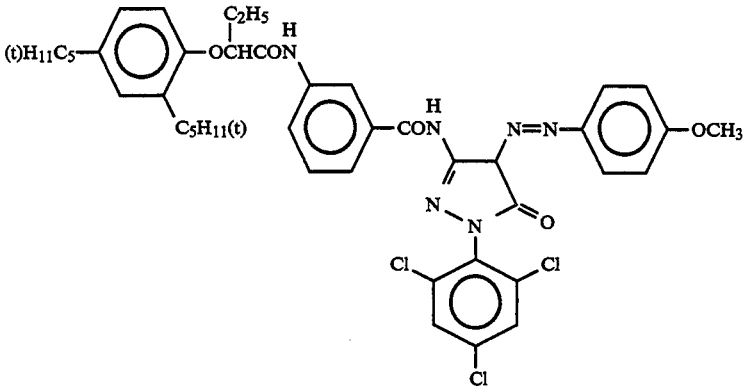
ExF-1:
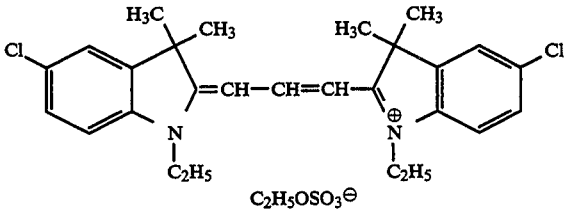
ExC-2:
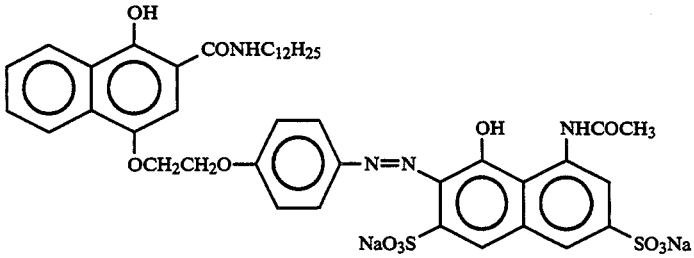
ExC-3:

-continued
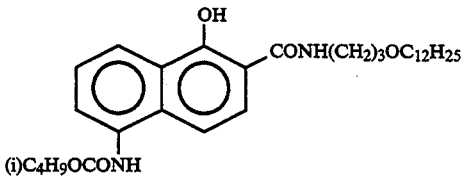
ExY-14:
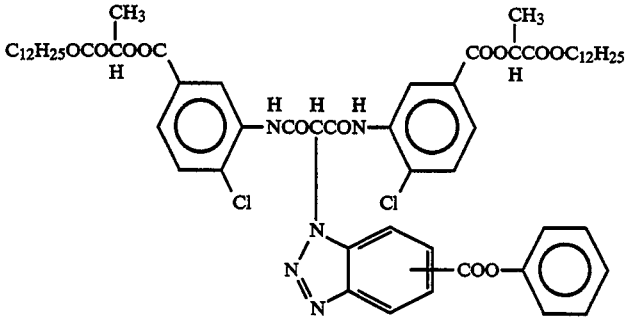
ExC-4:
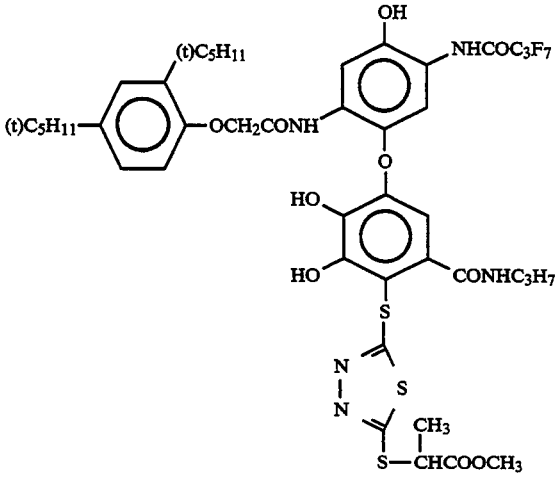
ExY-15:
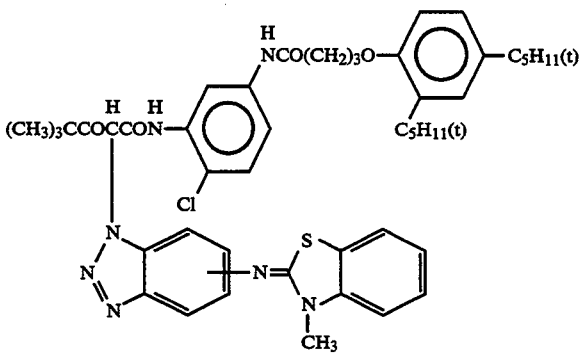
ExC-5:
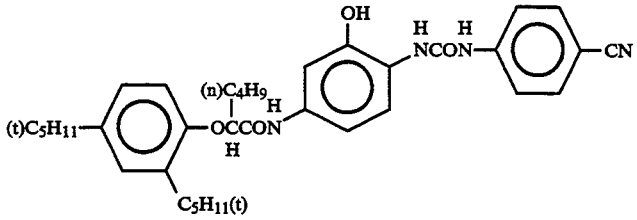
ExC-6:

-continued
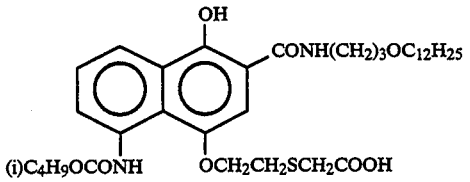
ExC-7:
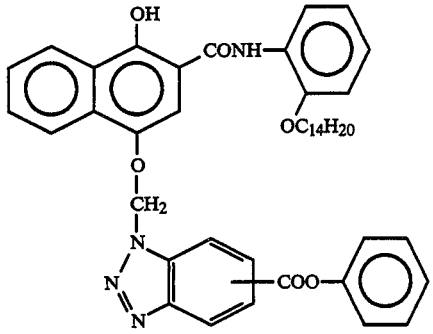
ExM-9:
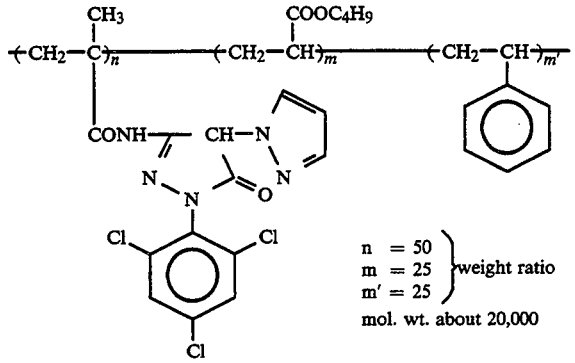
ExM-10:
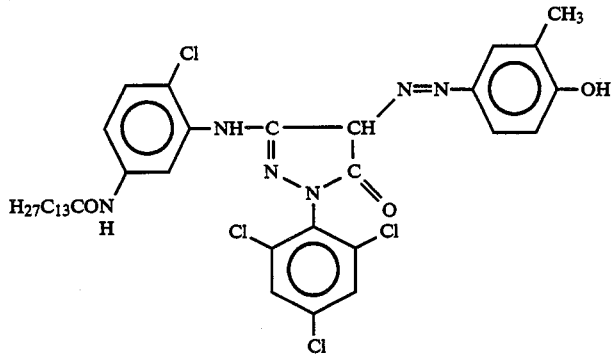
ExM-12:
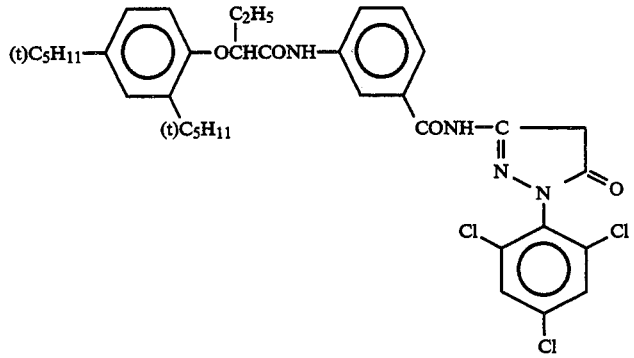

-continued
ExM-13:
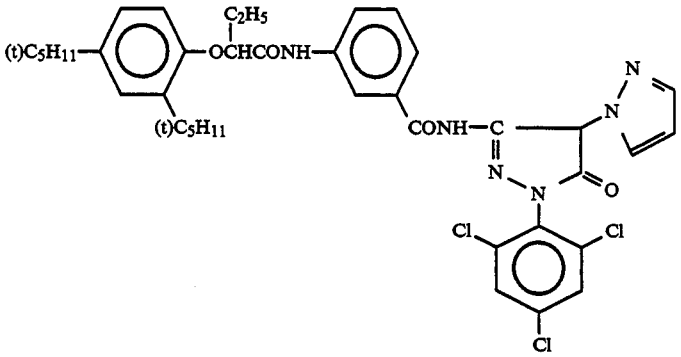
ExM-16:
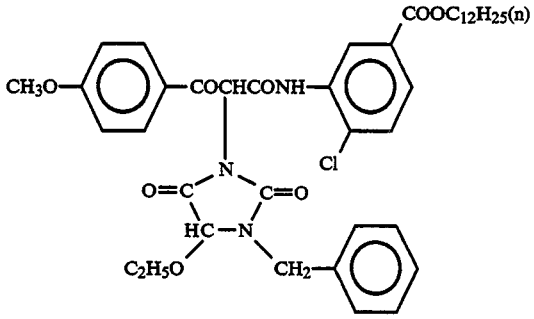
Cpd-1:
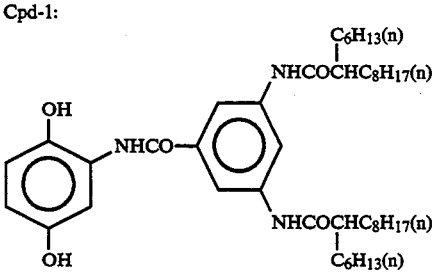
Cpd-2:
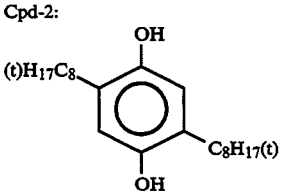
ExS-1:
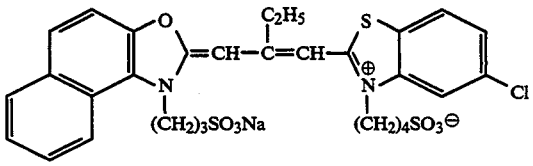
ExS-2:
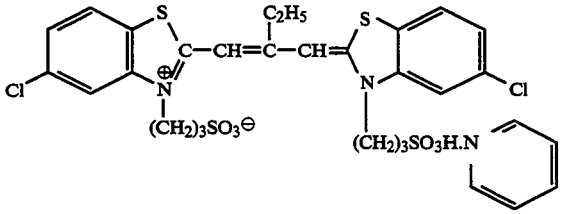
ExS-3:

-continued
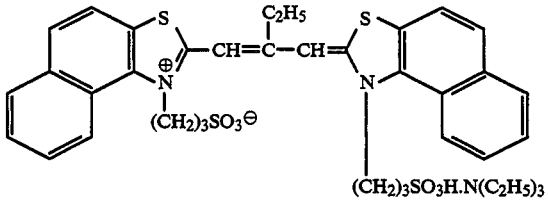
ExS-4:
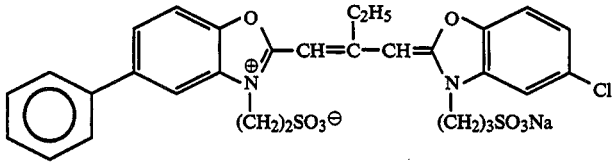
ExS-5:
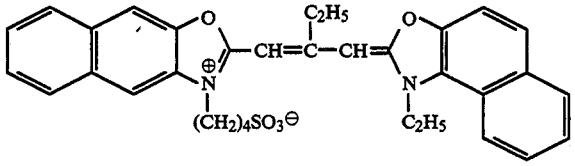
ExS-6:
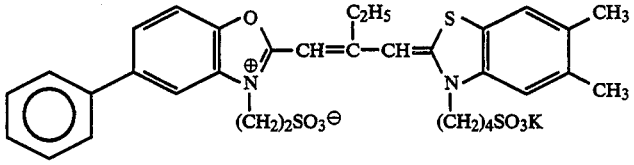
ExC-7:
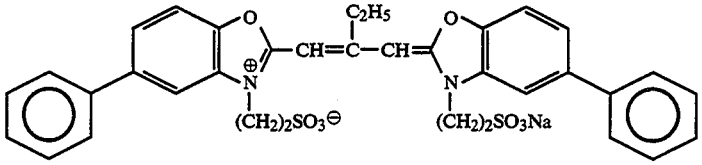
ExC-8:
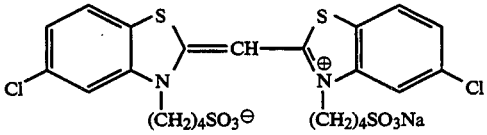
H-1:
$CH_2{=}CH{-}SO_2{-}CH_2{-}CONH{-}CH_2$
$CH_2{=}CH{-}SO_2{-}CH_2{-}CONH{-}CH_2$
Cpd-3:
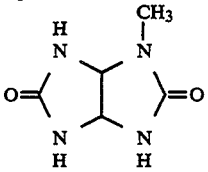
Cpd-4:
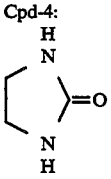

-continued

Cpd-5:

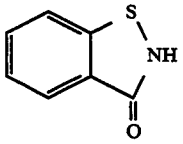

In addition, the dry thickness of the coated layers of sample 101 excluding the support and the subbing layer on the support was 17.6 μm and the swelling speed ($T_{\frac{1}{2}}$) was 8 seconds.

The sample thus prepared was slit to 35 mm in width. After applying an imagewise exposure, the sample was continuously processed by the following processing steps using an automatic processor until the accumulated replenisher amount for the fix solution reached three times the tank volume (i.e., running processing).

| Processing Step | | | | |
|---|---|---|---|---|
| Step | Processing Time | Processing Temp. | Replenishing Amount | Tank Volume |
| Color Development | 3 min. 15 sec. | 38° C. | 15 ml | 20 liters |
| Bleach | 4 min. 30 sec. | 38° C. | 10 ml | 40 liters |
| Wash | 2 min. 10 sec. | 35° C. | 10 ml | 20 liters |
| Fix | 4 min. 20 sec. | 38° C. | (1) 30 ml or (2) 15 ml | 30 liters |
| Wash (1) | 65 sec. | 35° C. | (*) | 10 liters |
| Wash (2) | 1 min. | 35° C. | 20 ml | 10 liters |
| Stabilizing | 65 sec. | 38° C. | 10 ml | 10 liters |
| Drying | 4 min. 20 sec. | 55° C. | | |

(*): Counter-current system from (2) to (1).

The replenishing amount was per 1 meter in length (35 mm in width) of the photographic material processed.

The composition of each processing solution is shown below.

| | Tank | Replenisher |
|---|---|---|
| Color Developer | | |
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | — |
| Potassium Iodide | 1.5 mg | — |
| Hydroxylamine Sulfate | 2.4 g | 3.6 g |
| 4-(N-Ethyl-N-β-hydroxyethylamino)-2-methylaniline Sulfate | 4.5 g | 7.2 g |
| Water to make | 1 liter | 1 liter |
| pH | 10.05 | 10.10 |
| Bleach Solution | | |
| 1,3-Propylenediaminetetraacetic Acid Ferric Ammonium Monohydrate | 144.0 g | 206.0 g |
| Ammonium Bromide | 84.0 g | 120.0 g |
| Ammonium Nitrate | 30.0 g | 41.7 g |
| Acetic Acid (98 wt %) | 28.0 g | 40.0 g |
| Hydroxyacetic Acid | 63.0 g | 90.0 g |
| Water to make | 1 liter | 1 liter |
| pH (adjusted by aqueous ammonia (27 wt %)) | 3.0 | 2.8 |

-continued

| | Tank | Replenisher |
|---|---|---|
| Fix Solution | | |
| Ethylenediaminetetraacetic Acid Disodium Salt | 0.5 g | 1.0 g |
| Sodium Sulfite | 7.0 g | 12.0 g |
| Sodium Bisulfite | 5.0 g | 9.5 g |
| Fixing Agent: Aqueous solution of Ammonium Thiosulfate (70 wt %) | 170.0 ml | 240.0 ml |
| or Fixing Agent shown in Table 1 below | 0.8 mol | 1.1 mol |
| Water to make | 1 liter | 1 liter |
| pH | 6.7 | 6.7 |
| Wash Water Tank = Replenisher | | |

City water was passed through a mixed bed column packed with a H-type strong acidic cation exchange resin (Amberlite IR-120B, trade name, made by Rohm & Haas Company) and a OH-type anion exchange resin (Amberlite IR-400, trade name) to reduce the calcium ion and magnesium ion concentrations below 3 mg/liter. Then, 20 mg/liter of dichloro sodium isocyanurate and 0.15 g/liter of sodium sulfate were added thereto. The pH of the solution was in the range of from 6.5 to 7.5.

| Stabilization solution | Tank | Replenisher |
|---|---|---|
| Formalin (37 wt %) | 2.0 ml | 3.0 ml |
| Polyoxyethylene-p-monononylphenyl Ether (average polymerization degree 10) | 0.3 g | 0.45 g |
| Ethylenediaminetetraacetic Acid Disodium Salt | 0.05 | 0.08 |
| Water to make | 1 liter | 1 liter |
| pH | 5.0–8.0 | 5.0–8.0 |

After the completion of running processing, the same sample type as used for the running processing was processed as described above, except that the fixing time was shortened to 2 minutes or 3 minutes.

The residual salver amount at the unexposed portions of the sample thus processed was measured using a fluroescent X ray analyzer.

Also, the extent of precipitations in the fix bath and wash bath (1) were visually evaluated.

The results obtained are shown in Table 1.

From the results shown in Table 1, it is clearly seen that when the compound of formula (I) of this invention was used, the liquid stability was excellent without precipitation in the running processing. Furthermore, desilvering was complete at a fixing time of 3 minutes, which clearly shows that the fixing ability of the compound of formula (I) of this invention is superior to that of a thiosulfate. Also, the effect of this invention was particularly remarkable when the replenishing amount was reduced.

TABLE 1

| Fixing Agent | Replenishing Amount for Fix Bath | Residual Silver Amount (μg/cm²) Fixed 2 min. | Fixed 3 min. | Presence of Precipitation in Fix Bath | Presence of Precipitation in Wash Bath | |
|---|---|---|---|---|---|---|
| Ammonium | (1) | 25 | 4.0 | Δ | Δ | Comparison |
| Thiosulfate | (2) | 35 | 8.5 | X | X | |
| Compound-1 | (1) | 11 | 0.8 | ○ | ○ | Invention |
| | (2) | 15 | 1.1 | ○ | ○ | |
| Compound-4 | (1) | 13 | 0.9 | ○ | ○ | Invention |
| | (2) | 15 | 1.1 | ○ | ○ | |
| Compound-18 | (1) | 10 | 0.7 | ○ | ○ | Invention |
| | (2) | 16 | 1.0 | ○ | ○ | |
| Compound-19 | (1) | 11 | 0.8 | ○ | ○ | Invention |
| | (2) | 18 | 1.1 | ○ | ○ | |

Evaluation of the presence of precipitations:
○: No precipitation by visual observation
Δ: Small amount of precipitation
X: Large amount of precipitation

EXAMPLE 2

The procedure of Example 1 was repeated, except for using Compound-2, 3, 9, 12, 13, 14, 20, 23, 25, 26, or 32 in place of Compound-1 in Example 1. In each case, good results were obtained as in Example 1; namely, the fixing ability was high and the precipitates were not formed in the running processing. Also, the effects of the invention were pronounced when the replenishing amount was reduced.

EXAMPLE 3

A multilayer color photographic paper having the layer structure shown below was prepared on a paper support, both surfaces of which were coated with polyethylene. The coating compositions were prepared as follows.

Preparation of Coating Composition for Layer 1

In 27.2 ml of ethyl acetate and 8.2 g of a solvent (solv-1) were dissolved 19.1 g of a yellow coupler (exY), 4.4 g of a color image stabilizer (cpd-1), and 0.7 g of a color image stabilize (cpd-7), and the solution obtained was dispersed by emulsification in 185 ml of an aqueous 10 wt % gelatin solution containing 8 ml of an aqueous solution of 10 wt % sodium dodecylbenzenesulfonate.

On the other hand, to a silver chlorobromide emulsion (cubic, a 3:7 mixture (by mol ratio of silver) of large size emulsion having a mean grain size of 0.88 μm and a small size emulsion having a mean grain size of 0.70 μm, the variation coefficients of the grain size distributions were 0.08 and 0.10, each emulsion locally had 0.2 mol % silver bromide at the surface of the silver halide grain) were added the blue sensitizing dyes shown below to the large size emulsion each in an amount of $2.0\times10^{-4}$ mol per mol of silver and to the small size emulsion each in an amount of $2.5\times10^{-4}$ mol per mol of silver. Thereafter, the emulsion was sulfur sensitized.

The emulsified dispersion prepared as described above was mixed with the emulsion and the composition was adjusted as shown below to provide the coating composition for layer 1.

The coating compositions for layer 2 to 7 were also prepared in a similar manner as described above.

To each layer, 1-oxy-3,5-dichloro-s-triazine sodium salt was added as a gelatin hardening agent.

Spectral sensitizing dyes used for each layer were as follows.

For the blue-sensitive emulsion layer:

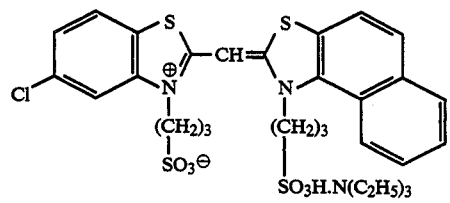

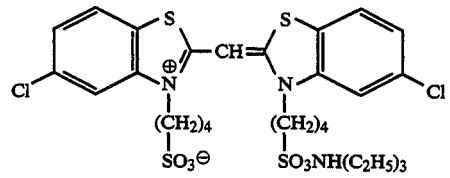

(each dye being added in an amount of $2.0\times10^{-4}$ mol to the large size emulsion and $2.5\times10^{-4}$ mol to the small size emulsion per mol of silver halide).

For the green-sensitive emulsion layer:

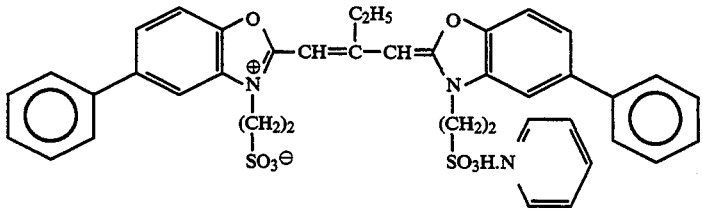

($4.0\times10^{-4}$ mol added to the large size emulsion and $5.6\times10^{-4}$ mol added to the small size emulsion per mol of silver halide), and

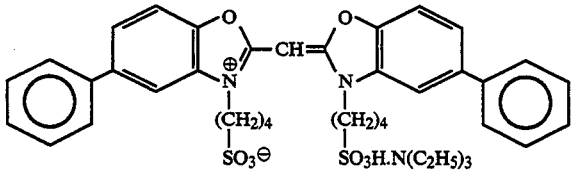

($7.0\times10^{-5}$ mol added to the large size emulsion and $1.0\times10^{-5}$ mol added to the small size emulsion per mol of silver halide).

For the red-sensitive emulsion layer:

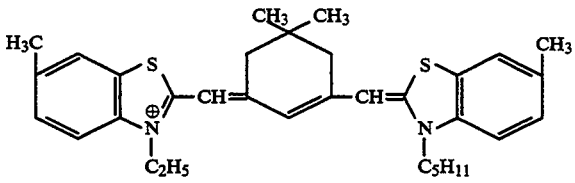

I⊖

($0.9\times10^{-4}$mol added to the large size emulsion and $1.1\times10^{-4}$mol added to the small size emulsion per mol of silver halide).

Also, to the red-sensitive emulsion layer was added the following compound in an amount of $2.6\times10^{-3}$ mol per mol of silver halide.

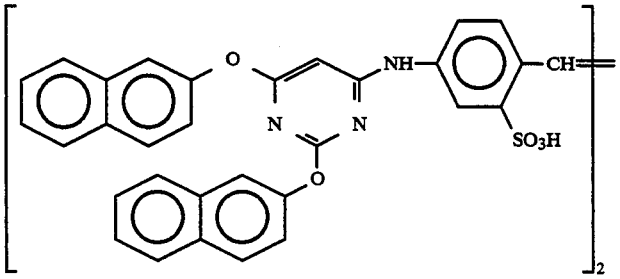

Also, to the blue-sensitive emulsion layer, the green-sensitive emulsion layer, and the red-sensitive emulsion layer was added 1-(5-methylureidophenyl)-5-mercaptotetrazole in amounts of $8.5\times10^{-5}$ mol, $7.7\times10^{-4}$ mol, and $2.5\times10^{-4}$ mol, respectively per mol of silver halide.

Furthermore, to the blue-sensitive emulsion layer and the green-sensitive emulsion layer was added 4-hydroxy-6-methyl-1,3,3a,7-tetraazaindene in amounts of $1\times10^{-4}$ mol and $2\times10^{-4}$ mol, respectively, per mol of silver halide.

Also, the following dyes were added to each emulsion layer for irradiation protection.

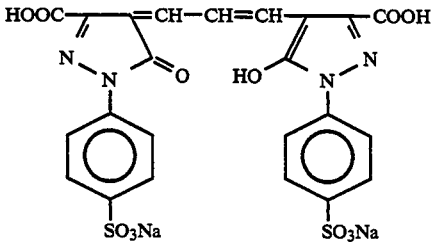

and

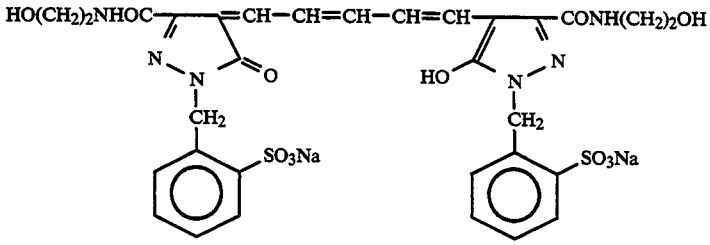

Layer Structure

The composition of each layer is shown below. The coating amounts are given in units of (g/m²), and the coating amounts for the silver halide emulsion are given in terms of silver.

Support

Polyethylene-coated paper ([the polyethylene coating at the emulsion layer side contained a white pigment ($TiO_2$) and a bluish dye (ultramarine blue)].

| Layer 1 (Blue-Sensitive Layer) | |
|---|---|
| Above described Silver Chlorobromide Emulsion | 0.30 |
| Gelatin | 1.86 |
| Yellow Coupler (exY) | 0.82 |
| Color Image Stabilizer (cpd-1) | 0.19 |
| Solvent (Solv-1) | 0.35 |
| Color Image Stabilizer (cpd-7) | 0.06 |

| Layer 2 (Color Mixing Inhibition Layer) | |
|---|---|
| Gelatin | 0.99 |

-continued

| | |
|---|---|
| Color Mixing Inhibitor (cpd-5) | 0.08 |
| Solvent (Solv-1) | 0.16 |
| Solvent (Solv-4) | 0.08 |
| Layer 3 (Green-Sensitive Layer) | |
| Silver Chlorobromide Emulsion (cubic, a.1:3 mixture (by mol ratio of silver) of large size emulsion having a mean grain size of 0.55 μm and small size emulsion having a mean grain size of 0.39 μm, variation coeff. of grain size distribution 0.10 and 0.08, respectively, each emulsion had locally 0.8 mol % AgBr at the surface of the grains) | 0.12 |
| Gelatin | 1.24 |
| Magenta Coupler (exM) | 0.20 |
| Color Image Stabilizer (cpd-2) | 0.03 |
| Color Image Stabilizer (cpd-3) | 0.15 |
| Color Image Stabilizer (cpd-4) | 0.02 |
| Color Image Stabilizer (cpd-9) | 0.02 |
| Solvent (solv-2) | 0.40 |
| Layer 4 (Ultraviolet Absorption Layer) | |
| Gelatin | 1.58 |
| Ultraviolet Absorbent (uv-1) | 0.47 |
| Color Mixing Inhibitor (cpd-5) | 0.05 |
| Solvent (solv-5) | 0.24 |
| Layer 5 (Red-Sensitive Layer) | |
| Silver Chlorobromide Emulsion (cubic, a 1:4 mixture (by mol ratio of silver) of large size emulsion having a mean grain size of 0.58 μm and small size emulsion having a mean grain size of 0.45 μm, variation coeff. of grain size distribution 0.09 and 0.11, respectively, each emulsion had locally 0.6 mol % AgBr at the surface of grains) | 0.23 |
| Gelatin | 1.34 |
| Cyan Coupler (exC) | 0.32 |
| Color Image Stabilizer (cpd 6) | 0.17 |
| Color Image Stabilizer (cpd-7) | 0.40 |
| Color Image Stabilizer (cpd-8) | 0.04 |
| Solvent (solv-6) | 0.15 |
| Layer 6 (Ultraviolet Absorption Layer) | |
| Gelatin | 0.53 |
| Ultraviolet Absorbent (uv-1) | 0.16 |
| Color Mixing Inhibitor (cpd-5) | 0.02 |
| Solvent (solv-5) | 0.08 |
| Layer 7 (Protective Layer) | |
| Gelatin | 1.33 |
| Acryl-Modified copolymer of Polyvinyl Alcohol (modified degree 17%) | 0.17 |
| Fluid Paraffin | 0.03 |

The compounds used for preparing the color photographic paper are shown below.

(exY) Yellow Coupler:

A 1/1 mixture (by mol ratio) of

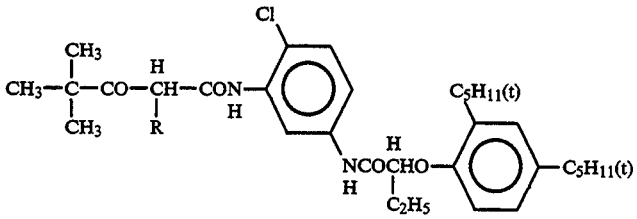

R = 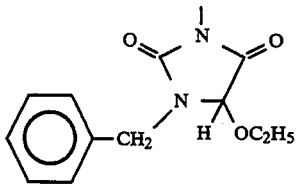 and

R = 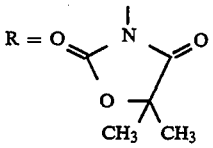

(exM) Magenta Coupler:

A 1/1 mixture (by mol ratio) of

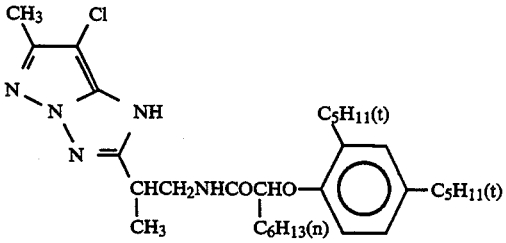

and

-continued
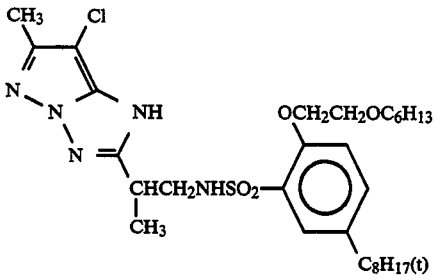
(exC) Cyan Coupler:
A 2:4:4 mixture (by weight ratio) of
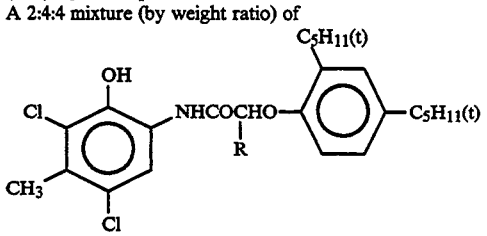
R = $C_2H_5$ and $C_4H_9$
and
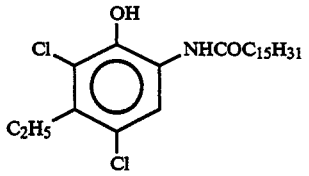
(cpd-1) Color Image Stabilizer:
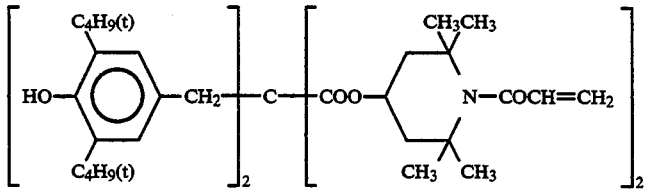
(cpd-2) Color Image Stabilizer:
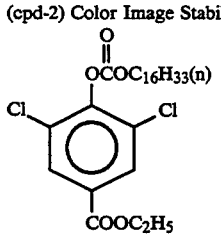
(cpd-3) Color Image Stabilizer:
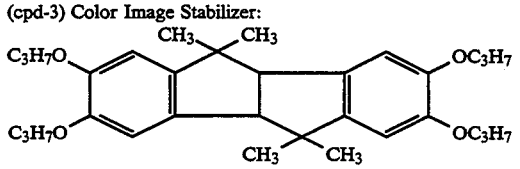
(cpd-4) Color Image Stabilizer:
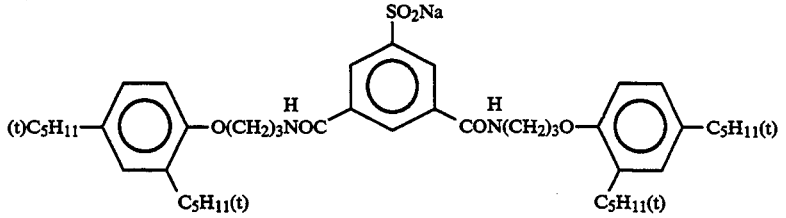
(cpd-5) Color Mixing Inhibitor:

-continued
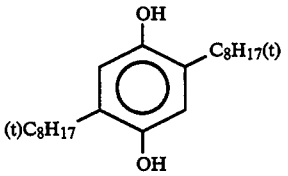
(cpd-6) Color Image Stabilizer:
A 2:4:4 mixture (by weight ratio) of
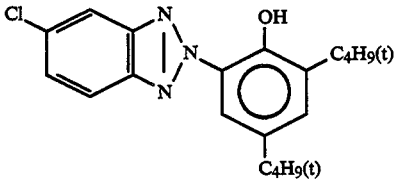
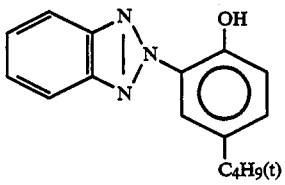
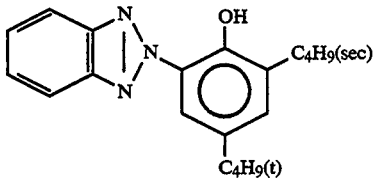
(cpd-7) Color Image Stabilizer:
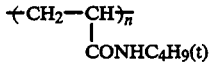
Average molecular weight 60,000
(cpd-8) Color Image Stabilizer:
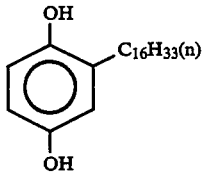
(cpd-9) Color Image Stabilizer:
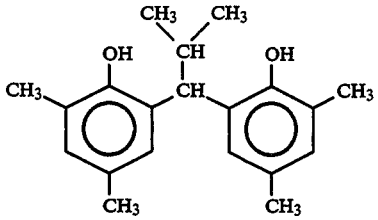
(uv-1) Ultraviolet Absorbent:
A 4:2:4 mixture (by weight ratio) of
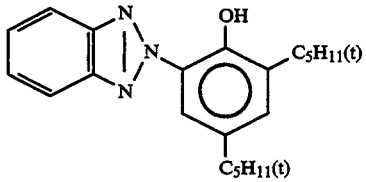

-continued

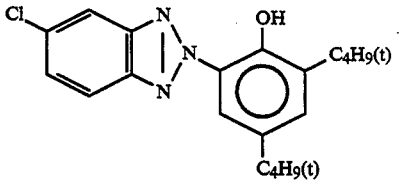

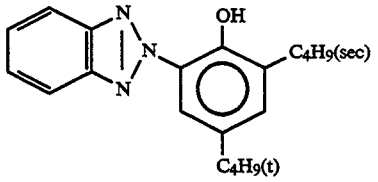

(solv-1) Solvent:

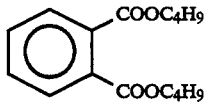

(solv-2) Solvent:
A 2:1 mixture (by volume) of

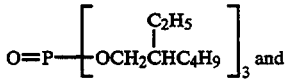

and

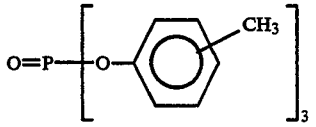

(solv-4) Solvent:

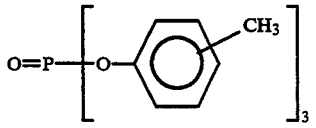

(solv-5) Solvent:

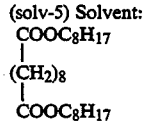

(solv-6) Solvent:

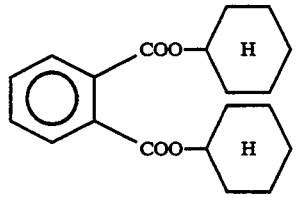

After imagewise exposing the aforesaid color photographic paper, continuous processing (running test) was conducted using a color photographic paper processor and the following processing steps until the replenishing amount for the blix solution reached twice the volume of the blix tank.

| Processing Step | Temperature (°C.) | Time (sec.) | Replenishing amount | Tank volume (liter) |
|---|---|---|---|---|
| Color Development | 35 | 45 | 109 ml | 17 |

-continued

| Processing Step | Temperature (°C.) | Time (sec.) | Replenishing amount | Tank volume (liter) |
|---|---|---|---|---|
| Blix | 35 | 45 | (1) 61 ml or (2) 30 ml | 17 10 |
| Rinse (1) | 35 | 30 | — | 10 |
| Rinse (2) | 35 | 30 | — | 10 |
| Rinse (3) | 35 | 30 | 300 ml | 10 |

-continued

| Processing Step | Temperature (°C.) | Time (sec.) | Replenishing amount | Tank volume (liter) |
|---|---|---|---|---|
| Drying | 80 | 60 | | |

Note
(1): The replenishing amount was per square meter of the color photographic paper processed.
(2): To the blix solution were replenished the replenisher for the blix solution and the rinse (1) solution (121 ml).
(3): Three-tank counter-current system of rinse (3) to rinse (1) was used.

The composition of each processing solution was as follows.

| Color Developer | Tank Solution | Replenisher |
|---|---|---|
| Water | 800 ml | 800 ml |
| Ethylenediamine-N,N,N,N-tetramethylenephosphonic Acid | 3.0 g | 3.0 g |
| Triethanolamine | 5.0 g | 5.0 g |
| Potassium Chloride | 3.1 g | — |
| Potassium Bromide | 0.015 g | — |
| Potassium Carbonate | 25 g | 25 g |
| Hydrazinodiacetic Acid | 5.0 g | 7.0 g |
| N-Ethyl-N-(β-methanesulfonamidoethyl)-3-methyl-4-aminoaniline Sulfate | 5.0 g | 9.5 g |
| Fluorescent Whitening Agent (Whitex-4, trade name, made-by Sumitomo Chemical Company Ltd.) | 1.0 g | 2.5 g |
| Water to make | 1 liter | 1 liter |
| pH (with the addition of KOH) | 10.05 | 10.60 |

| | Tank Solution | (1) Replenisher | (2) Replenisher |
|---|---|---|---|
| Blix Solution | | | |
| Water | 600 ml | 150 ml | 150 ml |
| Ammonium Thiosulfate (70 wt %) | 100 ml | 245 ml | 245 ml |
| or the compound of this Invention (formula (I)) as indicated in Table 2. | 0.4 mol | 1.0 mol | 1.0 mol |
| Ammonium Sulfite | 45 g | 105 g | 105 g |
| Ethylenediaminetetraacetic Acid Iron(III) Ammonium Salt | 55 g | 135 g | 135 g |
| Ethylenediaminetetraacetic Acid | 3.0 g | 8.0 g | 8.0 g |
| Ammonium Bromide | 30 g | 75 g | 150 g |
| Nitric Acid (67 wt %) | 27 g | 68 g | 100 g |
| Water to make | 1 liter | 1 liter | 1 liter |
| pH | 5.80 | 5.60 | 5.40 |

-continued

Rinse Solution (Tank solution = Replenisher)

Ion-exchanged water (each of calcium ion and magnesium ion concentrations being less than 3 ppm).

After finishing the running process, the presence of precipitation in the rinse (1) bath was visually evaluated.

The results obtained are shown in Table 2.

From the results shown in Table 2, it is clearly seen that when the compound of formula (I) of this invention is used in place of the thiosulfate, the liquid stability is excellent without precipitation in the running processing. Also, the effect of this invention is pronounced when the amount of the replenisher is reduced.

TABLE 2

| Fixing Agent | Replenishing Amount for Blix Bath | Presence of Precipitation in Blix Bath | Resence of Precipitation in Rinse (1) Bath | |
|---|---|---|---|---|
| Ammonium Thiosulfate | (1) | Δ | X | Comparison |
| | (2) | X | XX | |
| Compound-1 | (1) | ○ | ○ | Invention |
| | (2) | ○ | ○ | |
| Compound-4 | (1) | ○ | ○ | " |
| | (2) | ○ | ○ | |
| Compound-18 | (1) | ○ | ○ | " |
| | (2) | ○ | ○ | |
| Compound-19 | (1) | ○ | ○ | " |
| | (2) | ○ | ○ | |
| Compound-25 | (1) | ○ | ○ | " |
| | (2) | ○ | ○ | |

Evaluation of the presence of precipitations:
○: No precipitation by visual observation
Δ: Small amount of precipitation
X: Large amount of precipitation
XX: Very large amount of precipitation

EXAMPLE 4

The procedure of Example 3 was repeated except for using Compound-3, 7, 9, 14, 20, 26, 29, or 32 in place of Compound-1 in Example 3. In each case, good results were obtained as in Example 3; namely, precipitates were not formed in the running processing. Also, the effects of the invention were pronounced when the replenishing amount was reduced.

EXAMPLE 5

Preparation of Silver Halide Emulsion

To 1 liter of gelatin were added 30 g of gelatin and 6 g of potassium bromide in a container. While keeping the container at 60° C., an aqueous silver nitrate (5 g as silver nitrate) and an aqueous solution potassium bromide containing 0.15 g of potassium iodide were added to the mixture with stirring by a double jet method over a period of 1 minute. Furthermore, an aqueous silver nitrate solution (145 g as silver nitrate) and an aqueous potassium bromide solution containing 4.2 g of potassium iodide were added thereto by a double jet method. In this case, the addition flow rate of the solutions was accelerated such that the flow rate upon finishing the addition thereof was 5 times that at the beginning of the addition. Then, after removing soluble salts by a flocculation method at35° C., the temperature was raised to 40° C., 75 g of gelatin was further added thereto, and the pH of the emulsion was adjusted to 6.7. The silver halide emulsion thus obtained contained tabular silver halide grains having a diameter of the projected area of 0.98 μm and a mean thickness of 0.138 μm, and the content of silver iodide was 3 mol %. The silver halide emulsion was chemically sensitized using both gold sensitization and sulfur sensitization.

Preparation of Photographic Light-Sensitive Material

To prepare the surface protective layer, an aqueous gelatin solution containing gelatin, polyacrylamide having an average molecular weight of 8,000, sodium polystyrenesulfonate, polymethyl methacrylate fine particles (mean particle size 3.0 μm), polyethylene oxide, and a hardening agent were used.

To the foregoing silver halide emulsion were added anhydro-5,5 '-dichloro-9-ethyl-3,3'-di(3-sulfopropyl )oxacarboxycyanine hydroxide sodium salt as a sensitizing dye in an amount of 500 mg/mol of Ag and potassium iodide in an amount of 200 mg/mol of Ag. Furthermore, to the emulsion were added 4-hydroxy-6-methyl-1,3,3a,7-tetraazaindene, 2,6-bis(hydroxyamino)-4-diethylamino-1,3,5-triazine, and nitron as stabilizers, trimethylolpropane as a dry antifoggant, a coating aid, and a hardening agent to provide a coating composition. The coating composition and the above-described coating composition for a surface protective layer were simultaneously coated on both surfaces of a polyethylene phthalate support to provide a photographic light-sensitive material. The coated silver amount of the photographic light-sensitive material was 2 g/m$^2$ per each surface of the support. Also, the swelling ratio according to the above-described definition was 180%.

A half of the photographic light-sensitive material was exposed to X rays with the other half of the photographic material unexposed and then processed by the developer, the fix solution and wash water shown below.

| Step | Processing Time (sec.) | Processing Temperature (°C.) | Replenishing Amount | Tank Volume |
|---|---|---|---|---|
| Development | 13.7 | 35 | 20 ml (+10 ml of diluting water) | 15 liters |
| Fix | 12.5 | 32 | (1) 10 ml (+30 ml of diluting water) (2) 5 ml (+15 ml of diluting water) | 15 liters |
| Wash | 6.2 | 20 | 500 ml | 10 liters |
| Squeeze roller washing bath | | | | 200 ml |

Replenishing amount: The amount per photographic material processed (10 inches×12 inches).

The composition of each processing solution was as follows.

| Developer | Tank Solution | Replenisher |
|---|---|---|
| Potassium Hydroxide | 24 g | 60 g |
| Sodium Sulfite | 40 g | 100 g |
| Potassium Sulfite | 50 g | 125 g |
| Diethylenetriaminepentaacetic Acid | 2.4 g | 6 g |
| Boric Acid | 10 g | 25 g |
| Hydroquinone | 35 g | 87.5 g |
| Diethylene Glycol | 11.2 g | 28 g |
| 4-Hydroxymethyl-4-methyl-1-phenyl-3-pyrazolidone | 2.5 g | 6.25 g |
| 5-Methylbenzotriazole | 0.06 g | 0.15 g |
| pH | 10.05 | 11.00 |

| Fix Solution | Tank Solution | (1) Replenisher | (2) Replenisher |
|---|---|---|---|
| Ammonium Thiosulfate | 140 g | 560 g | 560 g |
| or the compound of the Invention (Formula (I)) as shown in Table 3 | 1 mol | 4 mols | 4 mols |
| Sodium Sulfite | 15 g | 60 g | 60 g |
| Ethylenediamine-tetraacetic Acid Disodium Salt Dihydrate | 0.025 g | 0.1 g | 0.1 g |
| Sodium Hydroxide | 6 g | 24 g | 48 g |
| pH | 5.5 | 5.10 | 4.70 |

| Wash Water | Tank Solution | Replenisher |
|---|---|---|
| Ethylenediaminetetraacetic Acid Disodium Salt Dihydate | 0.5 g | 0.5 g |

Running processing of 50 sheets (10 inches×12 inches) of the photographic film (developing ratio for one film was 40%) per day was continued until the accumulated amount of the replenisher for the fix solution reached three times the tank volume.

When the photographic light-sensitive material was developed, the stirred liquid amount by circulation of the developer was set at 20 liters/min., and when the photographic light-sensitive material was not developed, i.e., was in a stand-by state, the stirred liquid amount was set at 6 liters/min.

After finishing running processing, the same sample as that in the running processing was processed by reducing the fixing time to 10.5 seconds or 11.5 seconds.

Also, the amount of residual silver at the unexposed portions of the processed samples was determined by a fluorescent X ray analyzer.

Also, the presence of precipitation in the fix bath was visually determined. The results obtained are shown in Table 3 below.

TABLE 3

| Fixing Agent | Replenishing Amount for Fix Bath | Residual Silver Amount (μg/cm$^2$) Fixed 10.5 min. | Fixed 11.5 min. | Presence of Precipitation in Fix bath | |
|---|---|---|---|---|---|
| Ammonium | (1) | 10.3 | 3.2 | Δ | Comparison |
| Thiosulfate | (2) | 15.5 | 5.1 | X | |
| Compound-1 | (1) | 5.1 | 0.9 | ○ | Invention |
| | (2) | 5.4 | 1.1 | ○ | |
| Compound-4 | (1) | 5.3 | 1.0 | ○ | " |
| | (2) | 5.9 | 1.2 | ○ | |
| Compound-18 | (1) | 5.0 | 0.8 | ○ | " |
| | (2) | 5.3 | 0.9 | ○ | |
| Compound-20 | (1) | 5.2 | 1.0 | ○ | " |
| | (2) | 5.6 | 1.2 | ○ | |

From the results of Table 3, it can be seen that when the compound of formula (I) for use in this invention was used, no precipitation occured in the running processing and the liquid stability was good. Furthermore, desilvering was complete at a fixing time of 11.5 seconds, which clearly shows that the fixing ability of the compound of formula (I) of this invention is superior to that of a thiosulfate. Also the effect of this invention was particularly remarkable when the replenishing amount was reduced.

EXAMPLE 6

The procedure of Example 5 was repeated, except that Compound-3, 5, 10, 12, 14, 19, 26 or 32 were used in place of Compound-1. In each case, good results were obtained as in Example 5; namely the fixing ability was high and precipitates were not formed in the running processing. Also, the effet of this invention was particularly remarkable when the replenishing amount was reduced.

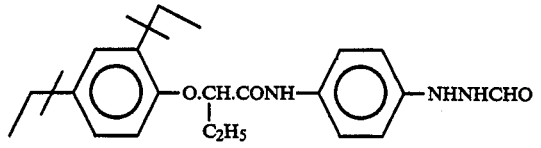

$7.1 \times 10^{-5}$ mole/Ag mole

Furthermore, to the emulsion were added 5-methylbenzotriazole, 4-hydroxy-1,3,3a,7-tetraazaindene, the following compounds (a) and (b), polyethylacrylate of 30% by weight to gelatin, and the following compound (c) as a gelatin hardening agent. Then, the resultant mixture was coated on a polyethylene terephthalate film of 150 μm in thickness having a subbing layer (0.5 μm) composed of a vinylidene chloride copolymer at a silver coverage of 3.4 g/m².

Compound (a)

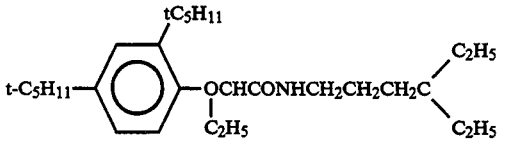

3.5 mg/m²

Compound (b)

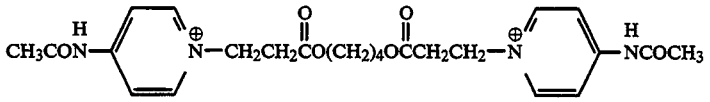

15.0 mg/m²

Compound (c)

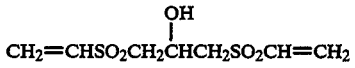

2.0 wt % to gelatin

EXAMPLE 7

Preparation of Light-Sensitive Emulsion

To an aqueous gelatin solution kept at 50° C. were simultaneously added an aqueous silver nitrate solution and an aqueous solution of potassium iodide and potassium bromide in the presence of potassium iridium (III) hexachloride in an amount of $4\times10^{-7}$ mol per mol of silver and ammonia, while keeping the pAg at 7.8 over a period of 60 minutes. A monodisperse emulsion was thereby obtained containing cubic silver iodobromide grains having a mean grain size of 0.28 μm and a mean silver iodide content of 0.3 mol %. The emulsion was subjected to desalting by a flocculation method. Next, 40 g of inert gelatin per mol of silver, 5,5'-dichloro-9-ethyl-3,3'-bis(3-sulfopropyl)oxacarbocyanine as a sensitizing dye and an aqueous solution of potassium iodide of $10^{-3}$ mol per mol of silver were added to the emulsion maintained at 50° C. The temperature was lowered after allowing the mixture to stand for 15 minutes.

Coating of Light-Sensitive Emulsion

The emulsion was liquified and the following hydrazine derivative was added thereto at 40° C.

Coating of Protective Layer

On the emulsion layer was coated a coating composition for the protective layer containing 1.5 g/m² of gelatin, polymethyl methacrylate particles (mean particle size 2.5 μm), and AgCl fine grains (0.08 μm) in an amount of 0.3 g/m² as silver using the following surface active agents.

Surface Active Agents:

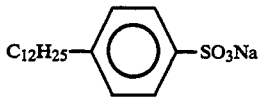

37 mg/m²

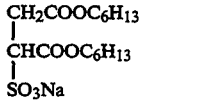

37 mg/m²

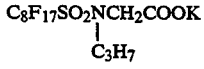

2.5 mg/m²

The sample was cut into a large area (50.8 cm×61.0 cm). After subjecting these sheets to 50% blackening exposure with tungsten light of 3200° K., 200 sheets were processed by the following processing steps.

| Step | Processing Step: Processing Time | Processing Temperature | Replenisher* |
|---|---|---|---|
| Development | 30 sec. | 34° C. | 240 ml |
| Fix | 30 sec. | 34° C. | (1) 390 ml |
| | | | (2) 250 ml |
| Wash | 30 sec. | 20° C. | 2 liters |

*The replenishing amount shown is given as the amount per square meter of the light-sensitive material processed.

The composition of each processing solution was as follows.

| Developer Tank liquid = Replenisher | |
|---|---|
| Hydroquinone | 50.0 g |
| N-Methyl-p-aminophenol | 0.3 g |
| Sodium Hydroxide | 18.0 g |
| Boric Acid | 20.0 g |
| Potassium Sulfite | 110.0 g |
| Ethylenediaminetetraacetic Acid Disodium Salt | 1.0 g |
| Potassium Bromide | 10.0 g |
| 5-Methylbenzotriazole | 0.4 g |
| 5-Mercaptobenzimidazole-5-sulfonic Acid | 0.3 g |
| Sodium 3-(5-Mercaptotetrazole)-benzenesulfonate | 0.2 g |
| 6-Dimethylamino-1-hexanol | 4.0 g |
| Sodium p-Toluenesulfonate | 15.0 g |
| 5-Sulfosalicylic Acid | 30.0 g |
| Water to make | 1 liter |
| pH adjusted to 11.7 with sodium hydroxide | |
| **Fix Solution Tank liquid = Replenisher** | |
| Ammonium Thiosulfate | 190.0 g |
| or the compound of formula (I) as indicated in Table 4 | 1 mol |
| Sodium Sulfite | 22.0 g |
| Ethylenediaminetetraacetic Acid Disodium Salt | 0.1 g |
| Tartaric Acid | 3.0 g |
| Aqueous Ammonia (27 wt %) | 10.0 g |
| Acetic Acid (90 wt %) | 30.0 g |
| Aluminum Sulfate (27 wt %) | 35.0 g |
| Water to make | 1 liter |
| pH adjusted to 4.8 with sodium hydroxide | |

After a series of continuous processing, the extent of precipitation in the fix solution was visually evaluated. Furthermore, directly before finishing the series of processing, the amount of residual silver at the unexposed portions of processed samples taken just prior to finishing the series of processing was determined by a fluorescent X-ray analyzer. The results are shown in Table 4 below.

TABLE 4

| Fixing Agent | Replenishing Amount for Fix Bath | Residual Silver Amount ($\mu g/cm^2$) | Presence of Precipitation in Fix bath | |
|---|---|---|---|---|
| Ammonium Thiosulfate | (1) | 0.9 | Δ | Comparison |
| | (2) | 3.5 | x | |
| Compound-1 | (1) | 0.6 | ○ | Invention |
| | (2) | 0.9 | ○ | |
| Compound-4 | (1) | 0.6 | ○ | " |
| | (2) | 0.8 | ○ | |
| Compound-18 | (1) | 0.5 | ○ | " |
| | (2) | 0.8 | ○ | |
| Compound-19 | (1) | 0.8 | ○ | " |
| | (2) | 1.0 | ○ | |

[Evaluation]
○: No precipitation by visual observation
Δ: Small amount of precipitation
X: Large amount of precipitation From the results shown in Table 4, it is clearly seen that when the compound of formula (I) of this invention is employed, the fixing ability is excellent and the fix solution has excellent liquid stability without precipitation when continuously processing a large amount of the light-sensitive material. Also, the effet of this invention was particularly remarkable when the replenishing amount was reduced.

EXAMPLE 8

The procedure of Example 7 was repeated except for using Compound-9, 13, 20 or 25 in place of Compound-1. In each case, good results were obtained as in Example 7; namely, the fixing ability was high and precipitates were not formed in the running processing. Also, the effects of the invention were pronounced when the replenishing amount was reduced.

EXAMPLE 9

By a double jet method, silver halide grains were prepared. After physical ripening and desalting treatment, the emulsion was chemically ripened to provide a silver chloroiodobromide emulsion (bromide content 30 mol %, iodide content 0.1 mol %). The mean diameter of the silver halide grains contained in the emulsion was 0.3 micron. The emulsion contained 0.6 of silver halide in 1 kg of the emulsion.

After liquifying 1 kg of the emulsion at 40° C., 70 ml of methanol solution of 0.05% by weight of the following sensitizing dye (1) was added thereto and an aqueous solution of sodium bromide was further added in a predetermined amount. Then, 25 ml of a methanol solution of 1.0% by weight of the following dye (2) was added thereto. After further adding thereto 30 ml of an aqueous solution of 1.0% by weight 1-hydroxy-3,5-dichlorotriazine sodium salt and 40 ml of an aqueous solution of sodium dodecylbenzenesulfonate, the resultant mixture was stirred.

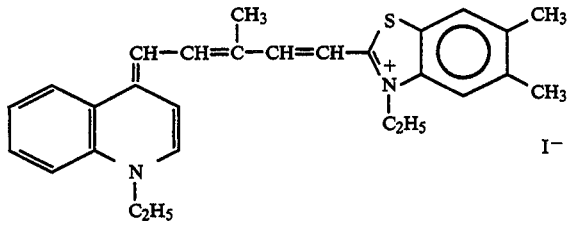

Dye (1)

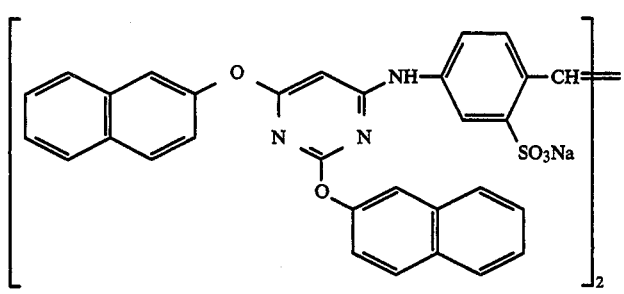

Dye (2)

The silver halide emulsion thus obtained was coated on a cellulose triacetate film base at a dry thickness of 5 microns followed by drying to provide a sample of the light-sensitive material.

The sample was cut into a predetermined size and subjected to a 50% blackening exposure using an actinometer having a light source of a color temperature of 2666° K. The exposed sample was subjected to running processing according to the following processing steps until the accumulated amount of the replenisher for the fix solution reached three times the tank volume thereof.

| Step | Processing Time (sec.) | Processing Temperature (°C.) | Replenishing Amount* | Tank Volume (liter) |
|---|---|---|---|---|
| | Processing step | | | |
| Development | 20 | 38 | 320 ml | 18 |
| Fix | 20 | 38 | (1) 320 ml<br>(2) 220 ml | 18 |
| Wash | 20 | 20 | 2 liters | 18 |

*Replenishing amount per square meter of the light-sensitive material processed.

The composition of each processing solution was as follows.

| Developer | Tank Liquid = Replenisher |
|---|---|
| Metol | 0.31 g |
| Anhydrous Sodium Sulfite | 39.6 g |
| Hydroquinone | 6.0 g |
| Anhydrous Sodium Carbonate | 18.7 g |
| Potassium Bromide | 0.86 g |
| Citric Acid | 0.68 g |
| Potassium Metabisulfite | 1.5 g |
| Water to make | 1 liter |
| **Fix Solution** | **Tank Liquid = Replenisher** |
| Ammonium Thiosulfate (70 wt %) | 200 ml |
| or the compound of formula (I) as indicated in Table 5 | 1 mol |
| Sodium Hydrogensulfite | 12.0 g |
| Ethylenediaminetetraacetic Acid Disodium Salt | 0.1 g |
| Tartaric Acid | 3.0 g |
| Aqueous Ammonia (27 wt %) | 7.0 g |
| Acetic Acid (90 wt %) | 20 0 g |
| Aluminum Sulfate (27 wt %) | 35.0 g |
| Water to make | 1 liter |

pH of fix solution (1) was adjusted to 4.2 with sodium hydroxide and pH of fix solution (2) was adjusted to 4.0 with sodium hydroxide.

The extent of precipitation in the fix solution after running processing was completed was visually evaluated. Furthermore, the amount of residual silver at the unexposed portions of a sample take just before the end of the running processing was determined using a fluorescent X ray analyzer. The results obtained are shown in Table 5.

TABLE 5

| Fixing Agent | Replenishing Amount for Fix Bath | Residual Silver Amount ($\mu g/cm^2$) | Presence of Precipitation in Fix bath | |
|---|---|---|---|---|
| Ammonium Thiosulfate | (1) | 0.8 | Δ | Comparison |
| | (2) | 3.1 | X | |
| Compound-1 | (1) | 0.6 | ○ | Invention |
| | (2) | 0.8 | ○ | |
| Compound-4 | (1) | 0.6 | ○ | " |
| | (2) | 0.9 | ○ | |
| Compound-18 | (1) | 0.5 | ○ | " |
| | (2) | 0.7 | ○ | |
| Compound-26 | (1) | 0.6 | ○ | " |
| | (2) | 0.9 | ○ | |

[Evaluation]
○: No precipitation by visual observation
Δ: Small amount of precipitation
X: Large amount of precipitation From the results shown in Table 5, it is clearly seen that the compound of formula (I) of this invention provided a high fixing ability, and the fix solution had excellent liquid stability without precipitation when processing a large amount of the light-sensitive material. Also, the effects of the invention were pronounced when a low replenishing amount was used.

While the invention has been described in detail and with reference to specific embodiments thereof, it will be apparent to one skilled in the art that various changes and modifications can be made therein without departing from the spirit and scope thereof.

What is claimed is:

1. A process for processing an imagewise exposed silver halide photographic material comprising a support having thereon at least one light-sensitive silver halide emulsion layer, comprising the steps of developing in a developing bath and processing in a processing bath having a fixing ability containing as a fixing agent at least one compound represented by the following formula (I) in an amount of from $2\times10^{-1}$ to 3 mol/l for a fixing bath and in an amount of from $2\times10^{-2}$ mol/l to 10 mol/l for a bleach-fixing bath:

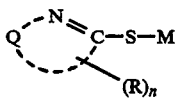

(I)

wherein Q represents an atomic group necessary for forming a 5- or 6-membered heterocyclic ring, which heterocyclic ring may be condensed with a carbon aromatic ring or a hetero-aromatic ring; R represents an alkyl group, an alkenyl group, an aralkyl group, an aryl group or a heterocyclic group, each group represented by R being substituted by at least one substituent selected from the group consisting of a carboxyl group or salt thereof, a sulfonic acid group or salt thereof, a phosphonic acid group or salt thereof, an amino group and an ammonium group, or R represents a single bond; n represents an integer of from 1 to 3; and M represents a cation group, wherein the processing bath having a fixing ability contains thiosulfate ion in an amount of less than 0.01 mol/l.

2. The process as in claim 1, wherein Q represents a tetrazole ring, triazole ring, imidazole ring, oxadiazole ring, triazaindene ring, tetraazaindene ring, or pentaazaindene ring; R represents an alkyl group having from 1 to 6 carbon atoms substituted by 1 or 2 substituents selected from a carboxyl group acid or salt thereof and sulfonic acid group or salt thereof; and n represents 1 or 2.

3. The process as in claim 1, wherein the compound represented by formula (I) is a compound represented by formula (II):

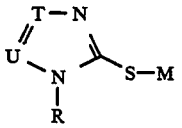

(II)

wherein M and R are defined as in formula (I), T and U each represents C—R′ or N; and R′ represents a hydrogen atom, a halogen atom, a hydroxy group, a nitro group, an alkyl group, an aklenyl group, an aralkyl group, an aryl group, a carbonamido group, a sulfonamido group, a ureido group, a thioureido group, or R as defined in formula (I); and when R′ is R as defined in formula (I), R′ may be the same as or different from R of formula (II).

4. The process as in claim 3, wherein T and U are each N, or T and U are each C—R′; R′ represents a hydrogen atom or an alkyl group having from 1 to 4 carbon atoms; and R represents an alkyl group having from 1 to 4 carbon atoms substituted by one or two substituents selected form a carboxyl group or salt thereof and a sulfonic acid group or salt thereof.

5. The process as in claim 1, further comprising washing in a water washing bath or stabilizing in a stabilizing bath subsequent to fixing or bleach-fixing, wherein the water washing bath or stabilizing bath contains at least one compound represented by formula (I) in a concentration of from $10^{-3}$ to 0.5 times the concentration of the compound represented by formula (I) in the fixing bath or bleach-fixing bath.

6. The process as in claim 1, wherein the processing bath having a fixing ability does not contain thiosulfate ion.

7. The process as in claim 1, wherein the processing bath having a fixing ability does not contain a fixing agent other than the compound represented by formula (I).

* * * * *